US009423216B2

(12) United States Patent
Cheng et al.

(10) Patent No.: US 9,423,216 B2
(45) Date of Patent: Aug. 23, 2016

(54) KEYMOD QUICK MOUNTING ARRANGEMENT

(71) Applicants: Carson Cheng, City of Industry, CA (US); Changan Tian, City of Industry, CA (US)

(72) Inventors: Carson Cheng, City of Industry, CA (US); Changan Tian, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days.

(21) Appl. No.: 14/582,202

(22) Filed: Dec. 24, 2014

(65) Prior Publication Data

US 2015/0316354 A1 Nov. 5, 2015

Related U.S. Application Data

(63) Continuation-in-part of application No. 14/218,893, filed on Mar. 18, 2014, now Pat. No. 9,341,441.

(51) Int. Cl.

| | |
|---|---|
| ***F41G 11/00*** | (2006.01) |
| ***F41C 27/00*** | (2006.01) |
| ***F41C 23/16*** | (2006.01) |

(52) U.S. Cl.

CPC ..... *F41G 11/001* (2013.01); *F41C 23/16* (2013.01); *F41C 27/00* (2013.01)

(58) Field of Classification Search

CPC ..... F41C 27/00; F41C 23/16

See application file for complete search history.

(56) References Cited

U.S. PATENT DOCUMENTS

| | | | | |
|---|---|---|---|---|
| 8,166,694 | B2 * | 5/2012 | Swan | F41C 33/007 224/198 |
| 2006/0283070 | A1 * | 12/2006 | Murello | F41G 11/007 42/127 |
| 2012/0167434 | A1 * | 7/2012 | Masters | F41C 23/16 42/90 |

* cited by examiner

*Primary Examiner* — Stephen M Johnson

(74) *Attorney, Agent, or Firm* — Raymond Y. Chan; David and Raymond Patent Firm

(57) ABSTRACT

A KeyMod quick mounting arrangement is arranged for detachably coupling an accessory at a firearm having a KeyMod mounting slot, wherein the arrangement includes a mounting body extended from the accessory, a positioning member protruded from a second side of the mounting body for detachably engaging with a narrow slot portion of the mounting slot, and a coupling head having a head portion outwardly protruded from said second side of the mounting body. In a securing position, the head portion of the coupling head is arranged for being disposed in an enlarged slot portion of the mounting slot so as to secure the accessory at the firearm. In a releasing position, the head portion of the coupling head is arranged for disengaging with the enlarged slot portion of the mounting slot so as to enable the accessory to be detached from the firearm.

20 Claims, 35 Drawing Sheets

KEYMOD QUICK MOUNTING ARRANGEMENT

CROSS REFERENCE OF RELATED APPLICATION

This is a Continuation-In-Part application that claims the benefit of priority under 35 U.S.C. §119 to a non-provisional application, application Ser. No. 14/218,893, filed Mar. 18, 2014, now U.S. Pat. No. 9,341,441.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a firearm accessory attachment system of a firearm, and more particular to a KeyMod quick mounting arrangement, which provides a quick and precise attachment for a firearm accessory to be detachably mounted at the firearm.

2. Description of Related Arts

Conventional accessory mounts, such as "Picatinny rail system or "Weaver" rail system, have evolved in the firearm industry from a military standard. The conventional accessory mount generally provides a rail comprising a plurality of T-shaped cross sectional raised ridges formed at the firearm, and an adapter provided at the accessory, wherein the accessory can be mounted at the rail by transversely sliding the adapter at the rail and fastening the adapter at the rail via a bolt. However, the conventional accessory mount has several drawbacks. The rail will only enable the accessory to be mounted at the firearm at the transverse direction. It is not ergonomic for a user to hold the firearm and mount the accessory to the rail in a transverse direction to the discharge axis of the firearm. In addition, the rail profile with the raised ridges will substantially increase the overall weight of the firearm. More importantly, the rail cannot provide a quick and precise attachment for the firearm because the adapter must be fastened with the rail by the bolt.

A "KeyMod" mounting arrangement is an improved system superior to the conventional accessory mount. The KeyMod mounting arrangement generally comprises a plurality of KeyMod mounting slots provided at the firearm and a KeyMod mounting nut provided at the accessory. In particular, each of the mounting slots, which is extended along the discharge axis of the firearm, has a keyhole configuration defining an enlarged slot portion with larger diameter and a narrower slot portion extended therefrom, wherein the slot is chamfered on the backside. Therefore, the mounting nut can be disposed in the enlarged slot portion and slid to the narrower slot portion. Then, the mounting nut can be fastened at the narrower slot portion by a bolt to lift the mounting nut at the backside of the mounting slot in order to secure the accessory at the firearm. The KeyMod mounting arrangement can solve the existing problems by providing an ergonomic mounting way to mount the accessory at the firearm corresponding to the discharge axis thereof, and by substantially reducing the overall weight of the firearm incorporating with the KeyMod mounting slots. However, the KeyMod mounting arrangement has several drawbacks.

The alignment between the mounting nut and the enlarged slot portion of the mounting slot must be precise. Especially when two or more mounting nuts are provided at the accessory, the user must correctly align the mounting nuts with the enlarged slot portions of the mounting slots respectively. Since the mounting nuts are movable, the user must hold the mounting nuts stationary before the mounting nuts are plugged into the enlarged slot portions of the mounting slots. It is worth mentioning that the mounting nuts can only be stationary or locked after the mounting nuts are lifted by the bolts to couple at the narrower slot portions of the mounting slots. In other words, the KeyMod mounting arrangement provides a displeasing mounting operation comparing with the conventional "Picatinny rail system or "Weaver" rail system. Furthermore, the KeyMod mounting arrangement still cannot provide a quick and precise attachment for the firearm because the mounting nut must be fastened with the mounting slot by the bolt.

SUMMARY OF THE PRESENT INVENTION

The invention is advantageous in that it provides a KeyMod quick mounting arrangement, which provides a quick and precise attachment for a firearm accessory to be detachably mounted at the firearm.

Another advantage of the invention is to a KeyMod quick mounting arrangement, which can incorporate an existing KeyMod slot rail to mount the accessory, such as laser module, scope mount, flashlight module, navigation light module, camera module, vertical grip, rail panel, hand stop, barricade support, at the firearm. In other words, the KeyMod quick mounting arrangement does not require to alter the original structural design of the KeyMod mounting structure of the firearm, so as to minimize the manufacturing cost of the KeyMod mounting structure of the firearm incorporating with the KeyMod quick mounting arrangement.

Another advantage of the invention is to a KeyMod quick mounting arrangement, which comprises a coupling head being slid and lifted in one single action to secure the accessory at the firearm.

Another advantage of the invention is to a KeyMod quick mounting arrangement, wherein the coupling head is stationary and locked in a releasing position and in a securing position, such that the coupling head can be precisely and rapidly plugged into the enlarged slot portion of the KeyMod slot to enhance the mounting operation of the accessory at the firearm.

Another advantage of the invention is to a KeyMod quick mounting arrangement, which comprises at least one positioning member arranged to engage with a second KeyMod slot adjacent to the KeyMod slot where the coupling head is coupled thereat, so as to ensure the corrected alignment between the accessory and the firearm and to prevent any unwanted longitudinal and/or rotational movement of the accessory with respect to the firearm after the KeyMod quick mounting arrangement is mounted to the firearm.

Another advantage of the invention is to a KeyMod quick mounting arrangement, wherein the user does not require any tool to fasten and secure the coupling head at the mounting slot, such that the KeyMod quick mounting arrangement provides a tool-less mounting system to speed up the mounting operation of the accessory at the firearm.

Another advantage of the invention is to provide a KeyMod quick mounting arrangement, wherein no expensive or complicated structure is required to employ in the present invention in order to achieve the above mentioned objects. Therefore, the present invention successfully provides an economic and efficient solution for providing a secure and reliable configuration for detachably mounting the accessory at the firearm with compact and ergonomic design.

Additional advantages and features of the invention will become apparent from the description which follows, and may be realized by means of the instrumentalities and combinations particular point out in the appended claims.

According to the present invention, the foregoing and other objects and advantages are attained by a KeyMod quick mounting arrangement for detachably coupling an accessory at a firearm having one or more KeyMod mounting slots, comprising:

a mounting body having a first side adapted for extending from the accessory to be detachably coupled with the firearm, and an opposed second side;

a positioning unit which comprises a positioning member protruded from the second side of the mounting body for detachably engaging with a narrow slot portion of the mounting slot; and a coupling head, which is movably extended from the mounting body between a releasing position and a securing position, having a head portion outwardly protruded from the second side of the mounting body, wherein in the securing position, the head portion of the coupling head is arranged for being disposed in an enlarged slot portion of the mounting slot so as to secure the accessory at the firearm, and in the releasing position, the head portion of the coupling head is arranged for disengaging with the enlarged slot portion of the mounting slot so as to enable the accessory to be detached from the firearm.

In accordance with another aspect of the invention, the present invention comprises a KeyMod quick mounting arrangement for detachably coupling an accessory at a firearm having one or more KeyMod mounting slots, comprising:

a mounting body having a first side adapted for extending from the accessory to be detachably coupled with the firearm, and an opposed second side; and a coupling head, which is movably extended from the mounting body between a releasing position and a securing position, having a head portion outwardly protruded from the second side of the mounting body, wherein the mounting body is stationary when the coupling head is moved between the releasing position and the securing position, wherein in the releasing position, the head portion of the coupling head is arranged for being disposed in an enlarged slot portion of the mounting slot, and in the securing position, the head portion of the coupling head is arranged for being slid to a narrower slot portion of the mounting slot for securing the accessory at the firearm.

In accordance with another aspect of the invention, the present invention comprises a KeyMod quick mounting arrangement, for detachably coupling an accessory at a firearm having one or more KeyMod mounting slots, comprising:

a mounting body having a first side adapted for extending from the accessory to be detachably coupled with the firearm, and an opposed second side;

a coupling head, which is movably extended from the mounting body between a releasing position and a securing position, having a head portion outwardly protruded from the second side of the mounting body; and an actuating member movably coupled at the mounting body to move the coupling head between the releasing position and the securing position, wherein in the releasing position, the head portion of the coupling head is arranged for being disposed in an enlarged slot portion of the mounting slot, and in the securing position, the head portion of the coupling head is arranged for being slid to a narrower slot portion of the mounting slot and for being moved toward the second side of the mounting head at the same time for securing the accessory at the firearm.

In accordance with another aspect of the invention, the present invention comprises a KeyMod quick mounting arrangement, for detachably coupling an accessory at a firearm having one or more KeyMod mounting slots, comprising:

a mounting body having a first side adapted for extending from the accessory to be detachably coupled with the firearm, and an opposed second side;

a coupling head, which is movably extended from the mounting body between a releasing position and a securing position, having a head portion outwardly protruded from the second side of the mounting body; and a locker unit provided at the mounting body for locking the coupling head in the releasing position and in the securing position, wherein in the releasing position, the head portion of the coupling head is locked in position for being disposed in an enlarged slot portion of the mounting slot, wherein after the locker unit is actuated to release the coupling head in the releasing position, the coupling head is moved to the securing position that the head portion of the coupling head is arranged for being slid to a narrower slot portion of the mounting slot for securing the accessory at the firearm.

In accordance with another aspect of the invention, the present invention comprises a KeyMod quick mounting arrangement, for detachably coupling an accessory at a firearm having a plurality of KeyMod mounting slots, comprising:

a mounting body having a first side adapted for extending from the accessory to be detachably coupled with the firearm, and an opposed second side;

a coupling head, which is movably extended from the mounting body between a releasing position and a securing position, having a head portion outwardly protruded from the second side of the mounting body, wherein in the releasing position, the head portion of the coupling head is arranged for being disposed in an enlarged slot portion of the mounting slot, and in the securing position, the head portion of the coupling head is arranged for being slid to a narrower slot portion of the mounting slot for securing the accessory at the firearm; and a positioning member protruded from the second side of the mounting body at a position adjacent to the coupling head, wherein the positioning member is arranged for engaging with a second mounting slot adjacent to the mounting slot where the coupling head is engaged therewith.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 3:
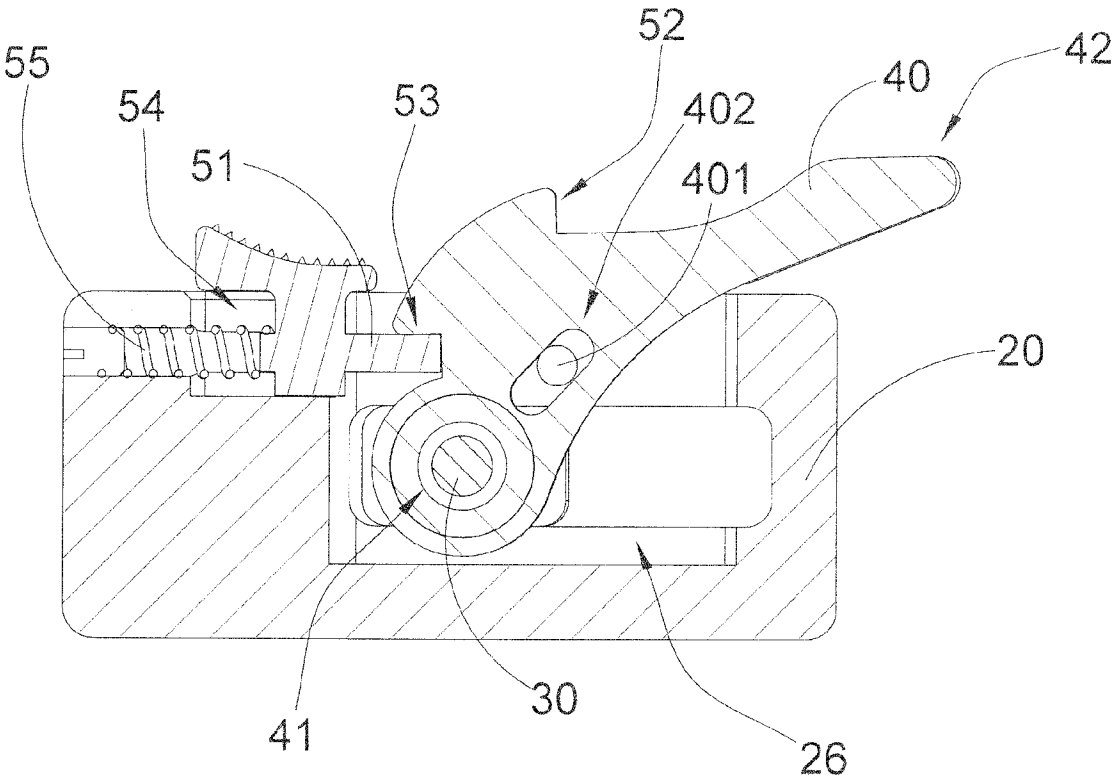
FIG. 3 is a bottom view of the KeyMod quick mounting arrangement according to the above preferred embodiment of the present invention, illustrating the coupling head in a securing position.
Figure 4:
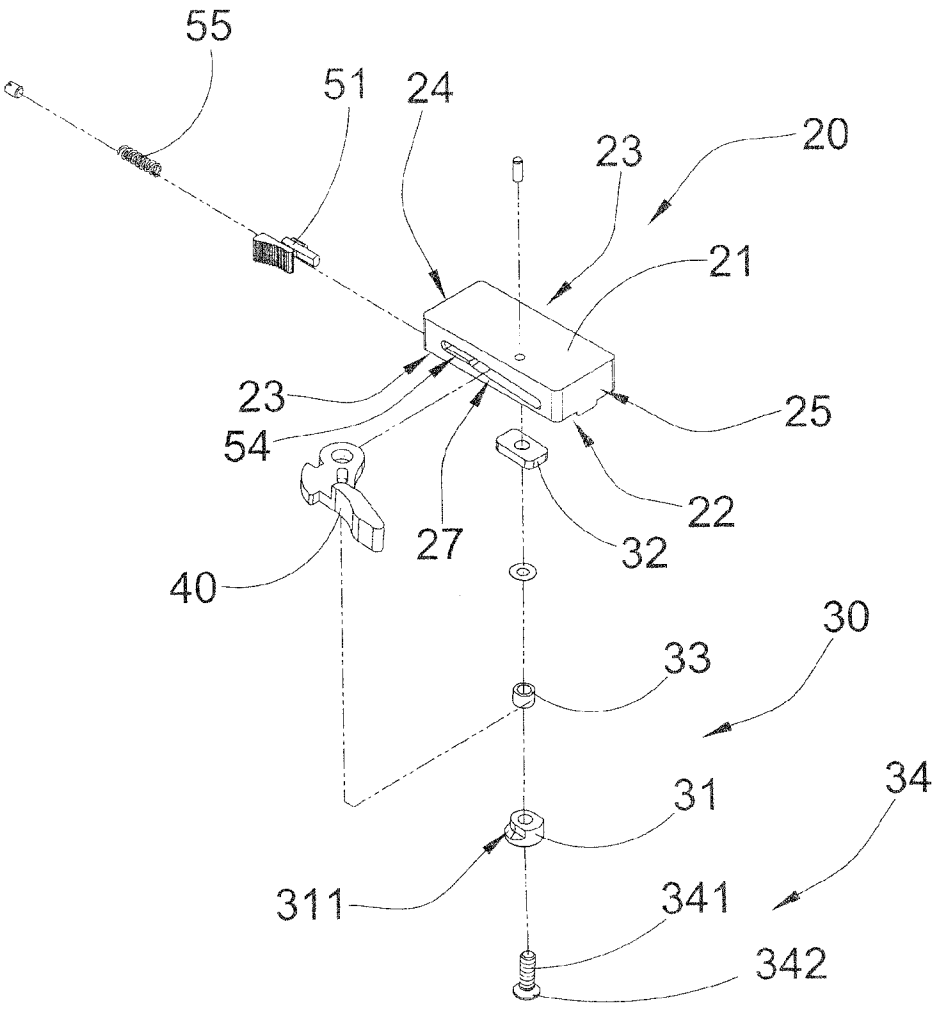
FIG. 4 is an exploded perspective view of the KeyMod quick mounting arrangement according to the above preferred embodiment of the present invention.
Figure 5:
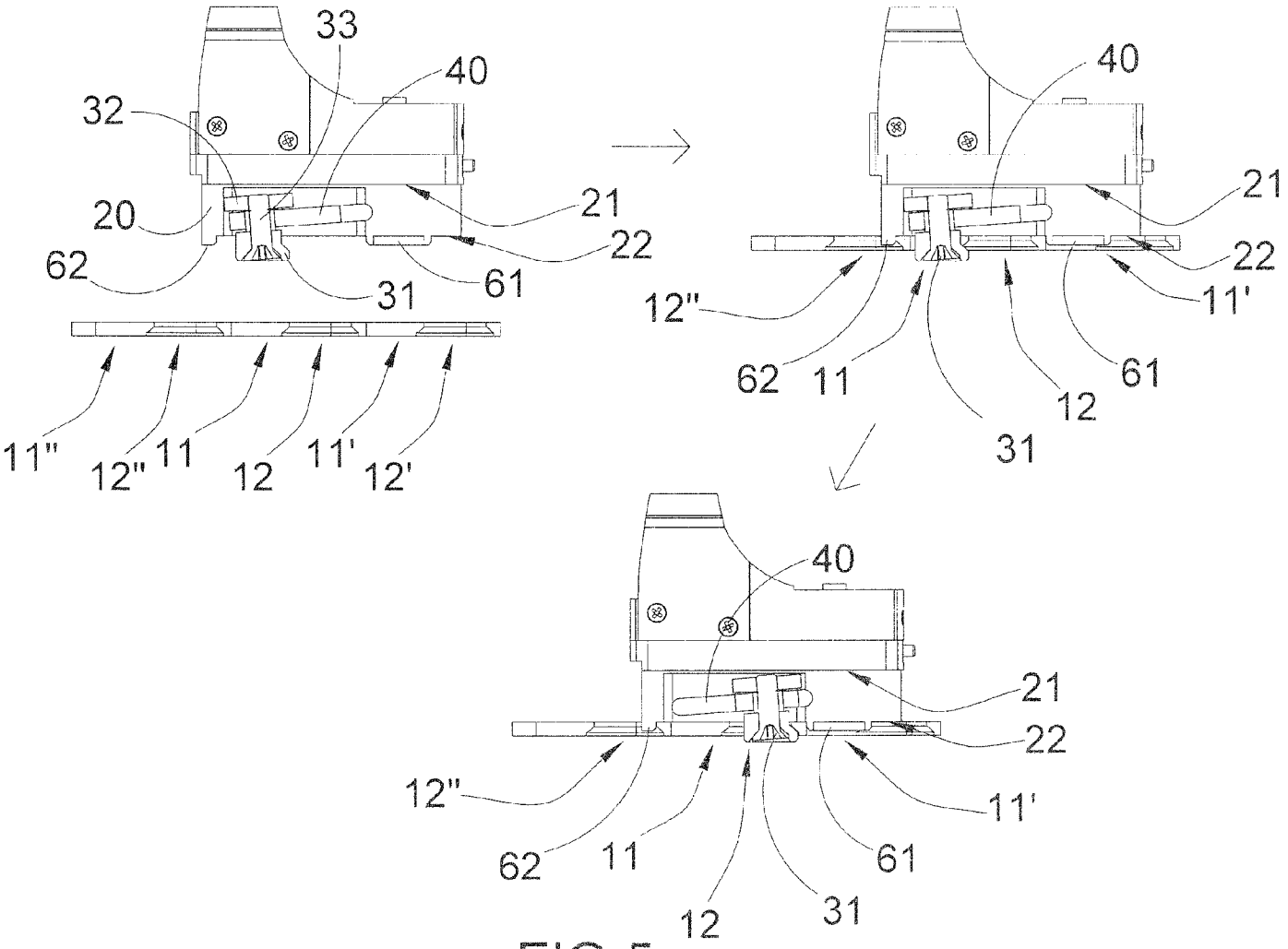
FIG. 5 is a side sectional view of the KeyMod quick mounting arrangement according to the above preferred embodiment of the present invention, illustrating the mounting operation of the arrangement to the KeyMod mounting slot and illustrating the accessory to be detachably mounted at the firearm via the arrangement.

Referring to FIGS. 1 to 7, a KeyMod quick mounting arrangement according to a preferred embodiment of the present invention is illustrated, wherein the arrangement of the present invention is arranged for detachably coupling an accessory at a firearm having one or more KeyMod mounting slots 10. For example, a micro-dot module is provided on the arrangement to detachably couple at the firearm as shown in FIG. 5.

For example, the firearm with a handguard provides a series of KeyMod mounting slots 10 aligning with a barrel axis of the firearm, wherein each of the mounting slots 10 has a Keyhole configuration to define an enlarged slot portion 11 and a narrower slot portion 12. The accessory, such as laser module, scope mount, flashlight module, navigation light module, camera module, vertical grip, rail panel, hand stop, barricade support, can be detachably coupled at the firearm via the arrangement of the present invention.

According to the preferred embodiment, the arrangement of the present invention comprises a mounting body 20 and a coupling head 30.

The mounting body 20 has a first side 21 arranged for extending from the accessory to be detachably coupled with the firearm, and an opposed second side 22 for coupling with the firearm at the mounting slot 10 via the coupling head 30. The mounting body 20 further has two sidewalls 23, a front side 24, and a rear side 25 to define an interior cavity therewithin, and forms a low profile configuration to minimize a distance between the first and second sides 21, 22 so as to minimize the distance between the accessory and the firearm. As shown in FIG. 5, the micro-dot module, as an example, is provided on the first side 21 of the mounting body 20.

The coupling head 30 is movably extended from the mounting body 10 and is moved between a releasing position and a securing position. In particular, the coupling head 30 has a head portion 31 outwardly protruded from the second side 22 of the mounting body 22, a retention portion 32 received in the interior cavity of the mounting body 22, and a neck portion 33 extended between the head portion 31 and the retention portion 32. The coupling head 30 further has a slanted engaging surface 311 formed at the head portion 31 to the mounting slot 10 with a chamfered configuration.

The coupling head 30 further comprises a head adjustor 34 for adjusting a distance between the head portion 31 and the retention portion 32. The head adjustor 34 comprises a threaded body 341 rotatably coupled at the retention portion 32 and an enlarged adjuster head 342 coupled at the head portion 31, such that when the head adjustor 34 is rotated, the threaded body 341 rotated at the retention portion 32 to selectively adjust the distance between the head portion 31 and the retention portion 32. Therefore, a portion of the threaded body 341 serves the neck portion 32 of the coupling head 30.

Accordingly, in the releasing position, the head portion 31 of the coupling head 30 is arranged for being disposed in the enlarged slot portion 11 of the mounting slot 10, and in the securing position, the head portion 31 of the coupling head 30 is arranged for being slid to the narrower slot portion 12 of the mounting slot 10 for securing the accessory at the firearm. In other words, the head portion 31 of the coupling head 30 is slid from the enlarged slot portion 11 of the mounting slot 10 to the narrower slot portion 12 thereof in order to couple the mounting body 20 at the firearm, so as to support the accessory at the firearm.

According to the preferred embodiment, the mounting body 20 is stationary when the coupling head 30 is moved between the releasing position and the securing position. In other words, after the head portion 31 of the coupling head 30 is disposed at the enlarged slot portion 11 of the mounting slot 10, only the coupling head 30 is moved to slide the head portion 31 of the coupling head 30 to the narrower slot portion 12 of the mounting slot 10. Therefore, the mounting body 20 is stationary during the sliding movement of the coupling head 30.

In order to enable the sliding movement of the coupling head 30 when the mounting body 20 is stationary, the mounting body 20 further has an elongated guiding slot 26 formed at the second side 22 of the mounting body 20. The coupling head 30 is slidably engaged at the guiding slot 26 in a position that the neck portion 33 of the coupling head 30 is slid along the guiding slot 26, such that the head portion 31 of the coupling head 30 is outwardly protruded from the second side 22 of the mounting body 20 through the guiding slot 26 and is guided to slide at the guiding slot 26 between the releasing position and the securing position.

The guiding slot 26 is a through slot longitudinally formed at the second side 22 of the mounting body 20 to communicate the interior cavity of the mounting body 20 with an exterior thereof. Therefore, the coupling head 30 can be longitudinally moved with respect to the mounting head 20 via the guiding slot 26, which is aligned with and parallel to the barrel axis of the firearm. In particular, the guiding slot 26 has a predetermined length to define two ends, wherein when the coupling head 20 is slid at one end of the guiding slot 26, the coupling head 20 is retained in the releasing position, and when the coupling head 20 is slid at another end of the guiding slot 26, the coupling head 20 is retained in the securing position. In other words, the length of the guiding slot 20 is corresponding to a distance of the mounting slot 10 between the enlarged slot portion 11 and the narrower slot portion 12. It is worth mentioning that a width of the guiding slot 26 is slightly larger than a size of the neck portion 33 of the coupling head 30 and is smaller than a size of each of the retention portion 32 and the head portion 31 of the coupling head 30. A distance between the retention portion 32 and the head portion 31 of the coupling head 30 is larger than a depth of the guiding slot 26, i.e. the thickness of the bottom wall of the mounting body 10.

Figure 6:
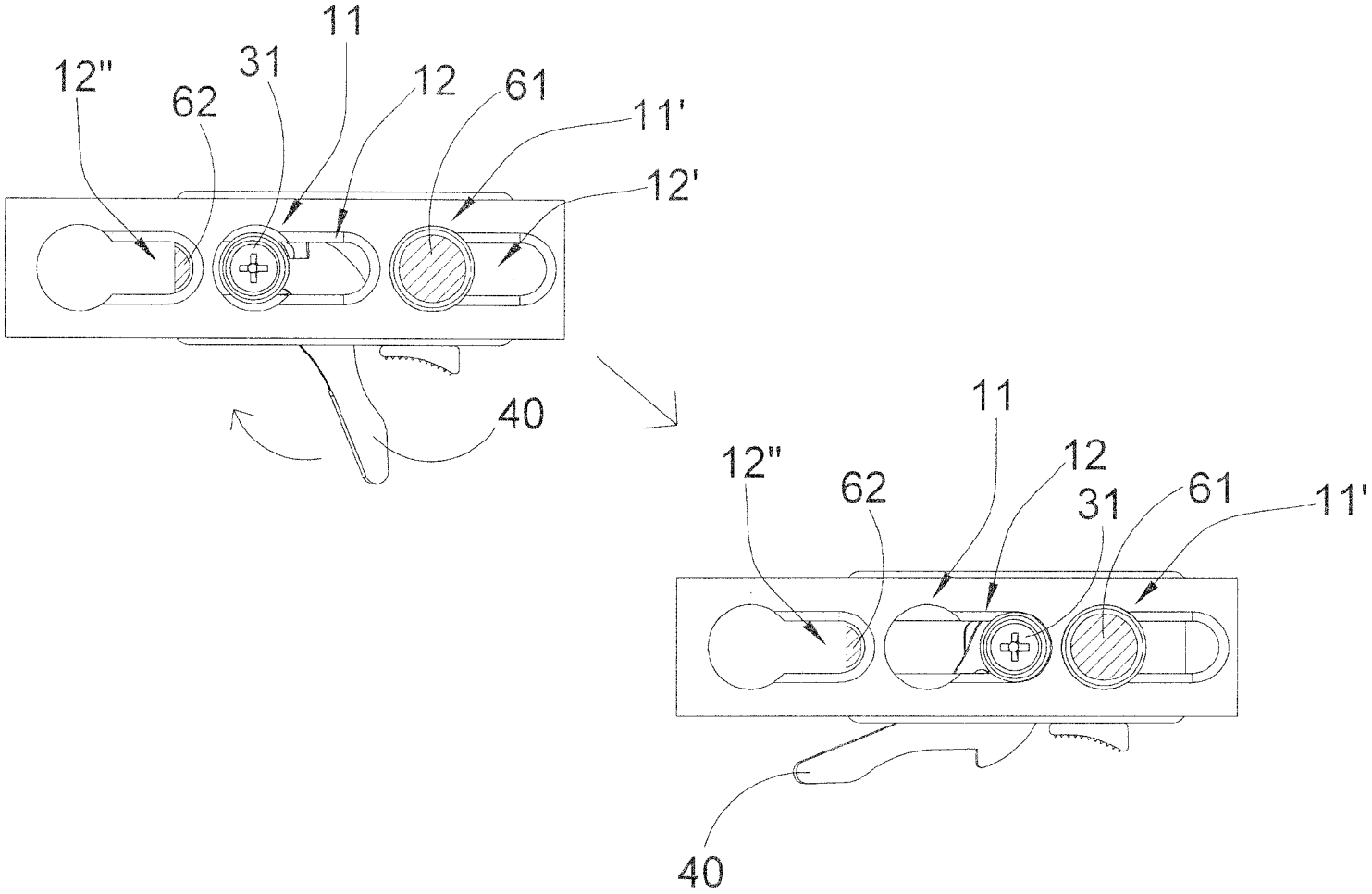
FIG. 6 is a bottom sectional view of the KeyMod quick mounting arrangement according to the above preferred embodiment of the present invention, illustrating the mounting operation of the arrangement to the KeyMod mounting slot.

According to the preferred embodiment, the coupling head 30 not only longitudinally moves with respect to the mounting head 20 but also vertically moves with respect to the mounting head 20 to adjust a distance between the head portion 31 of the coupling head 30 and the second side 22 of the mounting body 20, as shown in FIGS. 5 and 6. In particular, when the coupling head 30 is moved in the securing position, the head portion 31 of the coupling head 30 is lifted toward the second side 22 of the mounting body 20, such that a surrounding wall of the mounting slot 10 around the narrower slot portion 12 thereof will be sandwiched between the head portion 31 of the coupling head 30 and the second side 22 of the mounting body 20 so as to lock up the accessory at the firearm.

In particular, the mounting body 20 further has an elongated sliding channel 27 inclinedly formed at the mounting body 20, wherein the coupling head 30 is guided to slide at the sliding channel 27 to move the head portion 31 of the coupling head 30 toward the second side 22 of the mounting head 20 for gradually minimizing the distance between the head portion 31 of the coupling head 30 and the second side 22 of the mounting head 20 when the head portion 31 of the coupling head 30 is moved from the releasing position to the securing position. In other words, when the head portion 31 of the coupling head 30 is moved from the releasing position to the securing position, the head portion 31 of the coupling head 30 is concurrently moved toward the second side 22 of the mounting body 20.

As shown in FIG. 4, the sliding channel 27 is a through slot longitudinally and inclinedly formed at one of the sidewalls 23 of the mounting body 20 between the first and second sides 21, 22 thereof. Preferably, the sliding channel 27 is extended at 4 degrees with respect to the horizontal level. The inclination angle can be larger than 4 degrees depending on the desired vertical displacement of the head portion 31 of the coupling head 30. It is appreciated that the sliding channel 27 can be formed at one of the front or rear wall 24, 25 of the mounting body 20. The length of the sliding channel 27 must be equal or longer than the length of the guiding slot 26 to ensure the coupling head 20 to be moved between the releasing position and the securing position. It is worth mentioning that the guiding slot 26 is arranged to guide the longitudinally sliding movement of the coupling head 30 between the releasing position and the securing position. The sliding channel 27 is arranged to guide the vertical movement of the coupling head 30 to adjust the distance between the head portion 31 of the coupling head 30 and the second side 22 of the mounting head 20.

The arrangement of the present invention further comprises an actuating member 40 for manually moving the coupling head 20 between the releasing position and the securing position. The actuating member 40 is movably coupled at the mounting body 20 to drive the coupling head 20 to move. In particular, the actuating member 40 is extended from the coupling head 20 to engage with the sliding channel 27, such that when the actuating member 40 is moved at the sliding channel 27, the coupling head 20 is driven not only to longitudinally slide along the guiding slot 26 but also to vertically move via the sliding channel 27.

Figure 1:
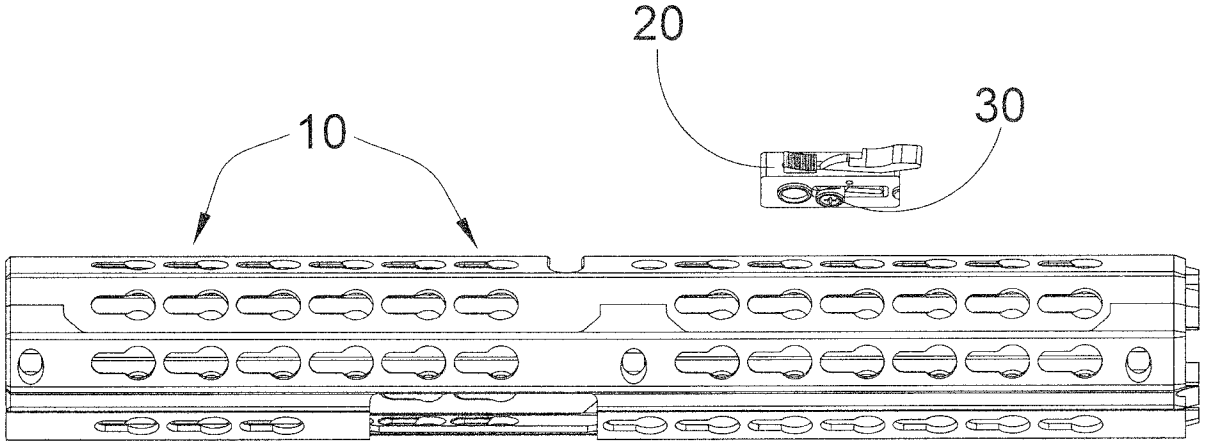
FIG. 1 is a perspective view of a KeyMod quick mounting arrangement according to a preferred embodiment of the present invention.
Figure 2:
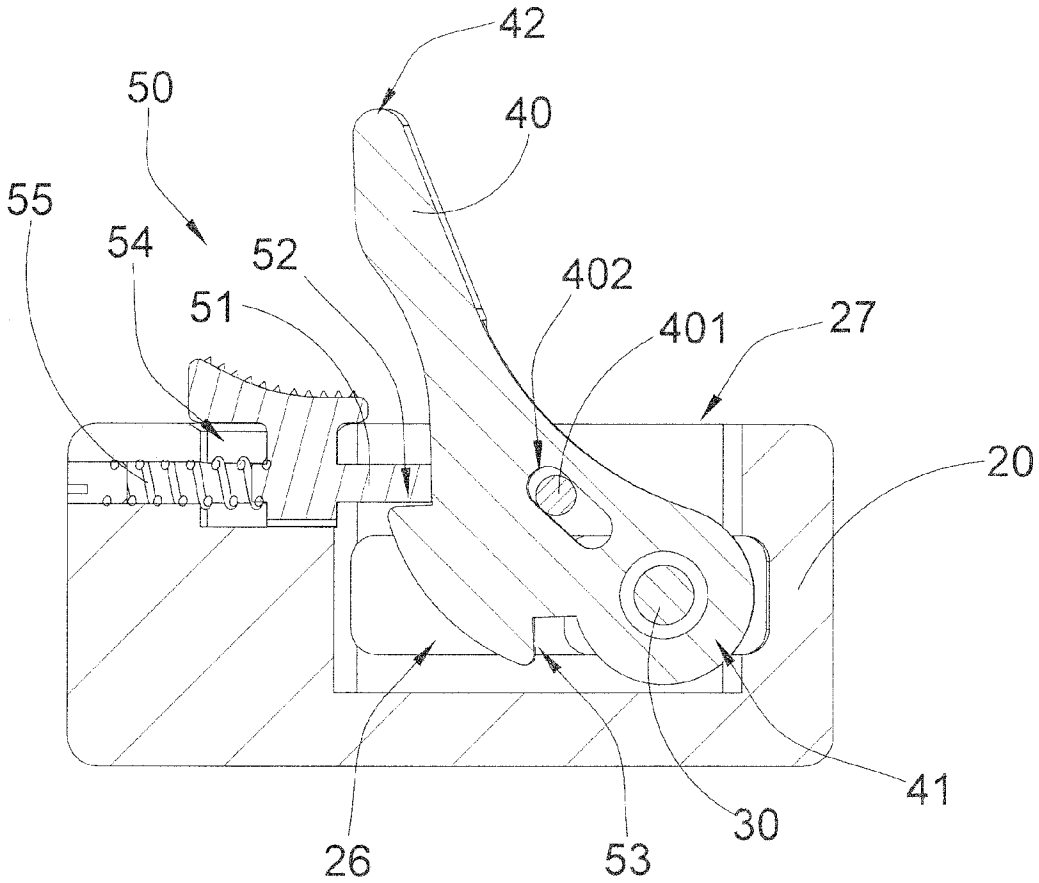
FIG. 2 is a bottom view of the KeyMod quick mounting arrangement according to the above preferred embodiment of the present invention, illustrating the coupling head in a releasing position.

As shown in FIGS. 2 to 4, the actuating member 40 is pivotally coupled at the mounting body 20 to define a pivot point 401 thereat. The actuating member 40 has a driving end 41 extended into the interior cavity of the mounting body 20 to couple at the coupling head 30 and an actuating end 42 extended out of the sidewall 23 of the mounting body 20 through the sliding channel 27. The driving end 41 of the actuating member 40 is rotatably coupled at the retention portion 32 of the coupling head 30.

The pivot point 401 of the actuating member 40 is defined between the driving end 41 and the actuating end 42. Therefore, by actuating the actuating end 42 of the actuating member 40, the driving end 41 of the actuating member 40 is pivotally moved to drive the coupling head 30 between the releasing position and the securing position. It is worth mentioning that the actuating member 40 has an elongated pivot slot 402 formed thereat, wherein a pivot axle affixed at the pivot point 401 is engaged with the pivot slot 402, so as to enable the driving end 41 of the actuating member 40 to move the coupling head 30 in a linear direction along the guiding slot 26 the pivotal movement of the actuating member 40.

It is worth mentioning that during the pivotal movement of the actuating member 40, the coupling head 20 is guided to longitudinally slide along the guiding slot 26. At the same time, the pivotal movement of the actuating member 40 is guided by the sliding channel 27 in order to vertically move the head portion 31 of the coupling head 30 toward the second side 22 of the mounting head 20 when the coupling head 20 is guided to longitudinally slide along the guiding slot 26 from the releasing position to the securing position. In other words, one single actuating action of the actuating member 40 will move the head portion 31 of the coupling head 30 being slid to the narrower slot portion 12 of the mounting slot 10 and being moved toward the second side 22 of the mounting head 20 at the same time for securing the accessory at the firearm.

As shown in FIGS. 2 to 4, the arrangement further comprises a locker unit 50 provided at the mounting body 20 for locking the coupling head 30 in the securing position. According to the preferred embodiment, the locker unit 50 is also arranged to lock up the coupling head 30 in the releasing position.

According to the preferred embodiment, the locker unit 50 comprises a locking latch 51, and first and second locking edges 52, 53 defined at the actuating member 40. When the locking latch 51 is engaged with the first locking edge 52, the coupling head 30 is locked in the releasing position, as shown in FIG. 2. When the locking latch 51 is engaged with the second locking edge 52, the coupling head 30 is locked in the securing position, as shown in FIG. 3.

In particular, when the actuating member 40 is pivotally moved to drive the coupling head 30 in the releasing position, the actuating member 40 is moved in a position that the locking latch 51 is engaged with the first locking edge 52. Likewise, when the actuating member 40 is pivotally moved to drive the coupling head 30 in the securing position, the actuating member 40 is moved in a position that the locking latch 51 is engaged with the second locking edge 53. As a result, the coupling head 30 will be locked and stationary in each of the releasing position and the securing position. It is worth mentioning that after the locking latch 51 of the locker unit 50 is actuated to release the coupling head 30 in the releasing position, the coupling head 30 is allowed to move to the securing position that the head portion 31 of the coupling head 30 is slid to the narrower slot portion 12 of the mounting slot 10 for securing the accessory at the firearm.

As shown in FIG. 4, the locker unit 50 further has an elongated locking slot 54 formed at the sidewall 23 of the mounting body 20 and is integrally extended from the sliding channel 27 end-to-end, wherein the locking latch 51 is slidably engaged at the locking slot 54. Preferably, the locking slot 54 is a horizontal through slot to communicate with the sliding channel 27.

When the locking latch 51 is slid along the locking slot 51 toward the sliding channel 27, the locking latch 51 is engaged with either the first or second locking edges 52, 53 at the actuating member 40. When the locking latch 51 is slid along the locking slot 51 away from the sliding channel 27, the locking latch 51 is disengaged with either the first or second locking edges 52, 53 so as to enable the pivotal movement of the actuating member 40.

The locker unit 50 further comprises a resilient element 55 supported within the interior cavity of the mounting body 20 for applying an urging force against the locking latch 51. The resilient element 55, according to the preferred embodiment, is a compression spring having two ends biased against the locking latch 51 and an inner wall of the interior cavity of the mounting body 20 to push the locking latch 51 toward the sliding channel 27 along the locking slot 51, so as to ensure the locking latch 51 to be engaged with either the first or second locking edges 52, 53 at the actuating member 40. Therefore, the user must intentionally slide the locking latch 51 along the locking slot 54 to move the locking latch 51 away from the sliding channel 27 by overcoming the spring force of the resilient element 55 in order to disengage the locking latch 51 with either the first or second locking edges 52, 53.

Figure 7A:
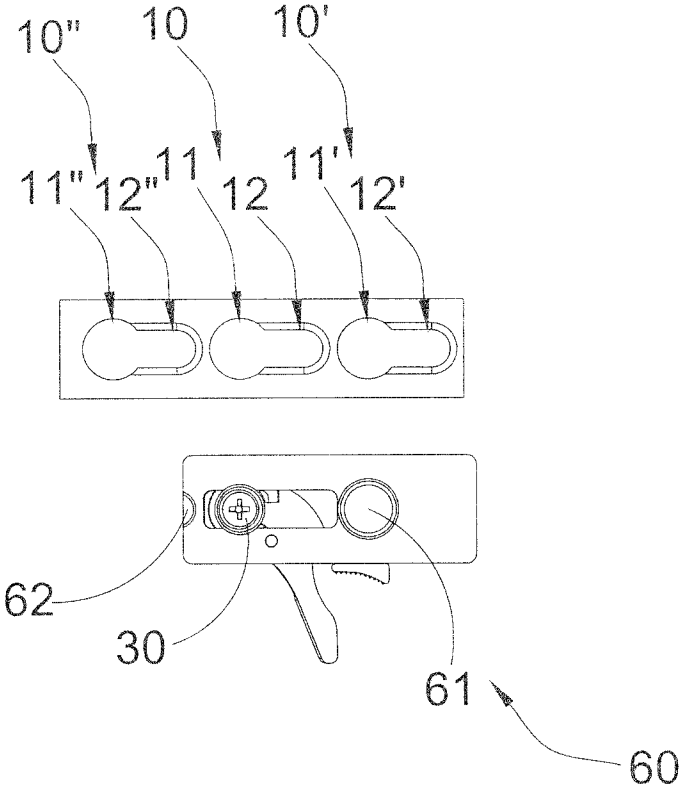
FIGS. 7A to 7G illustrates different configurations of the first and second positioning members incorporating with the coupling head of the KeyMod quick mounting arrangement according to the above preferred embodiment of the present invention.
Figure 7:
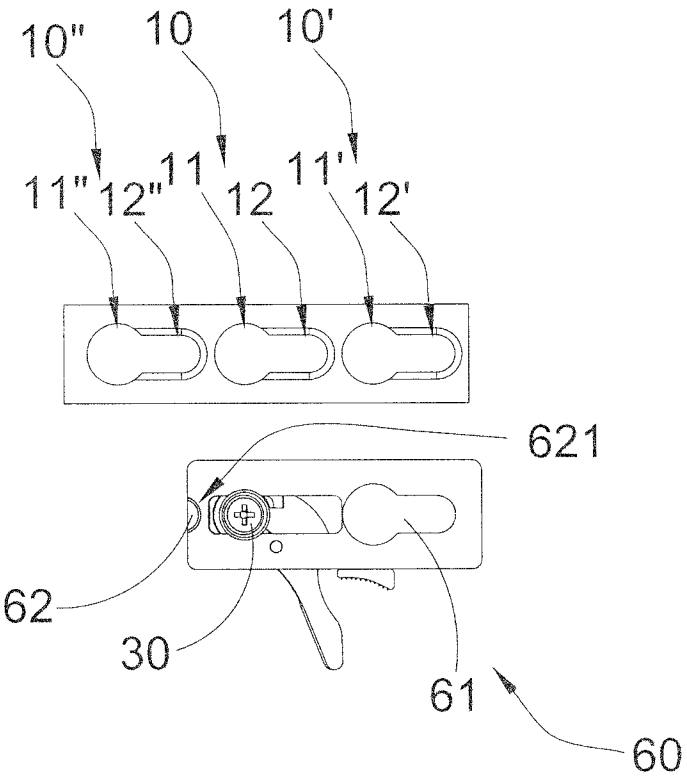
FIG. 7 illustrates the first and second positioning members incorporating with the coupling head of the KeyMod quick mounting arrangement according to the above preferred embodiment of the present invention.

As shown in FIG. 7, the arrangement further comprises a positioning unit 60 for ensuring the corrected alignment between the accessory and the firearm and for preventing any unwanted longitudinal and/or rotational movement of the accessory with respect to the firearm after the mounting body 20 is mounted to the firearm.

The positioning unit 60 comprises a first positioning member 61 protruded from the second side 22 of the mounting body 20 at a position adjacent to the coupling head 30, wherein the positioning member 61 is arranged for engaging with a second mounting slot 10' adjacent to the mounting slot 10 where the coupling head 30 is engaged therewith.

The positioning unit 60 further comprises a second positioning member 62 protruded from the second side 22 of the mounting body 20 at a position adjacent to the coupling head 30, wherein the second positioning member 62 is arranged for engaging with an edge of a third mounting slot 10" adjacent to the mounting slot 10 where the coupling head 30 is engaged therewith.

According to the preferred embodiment, the first and second positioning members 61, 62 are integrally protruded from the second side 22 of the mounting body 20 and are aligned at a centerline of the guiding slot 26, wherein the coupling head 30 is positioned between the two positioning members 61, 62. In particular, the first and second positioning members 61, 62 are arranged to engage with the second and third mounting slots 10', 10" respectively, wherein the mounting slot 10 for the coupling head 30 is located between the second and third mounting slots 10', 10".

Figure 7C:
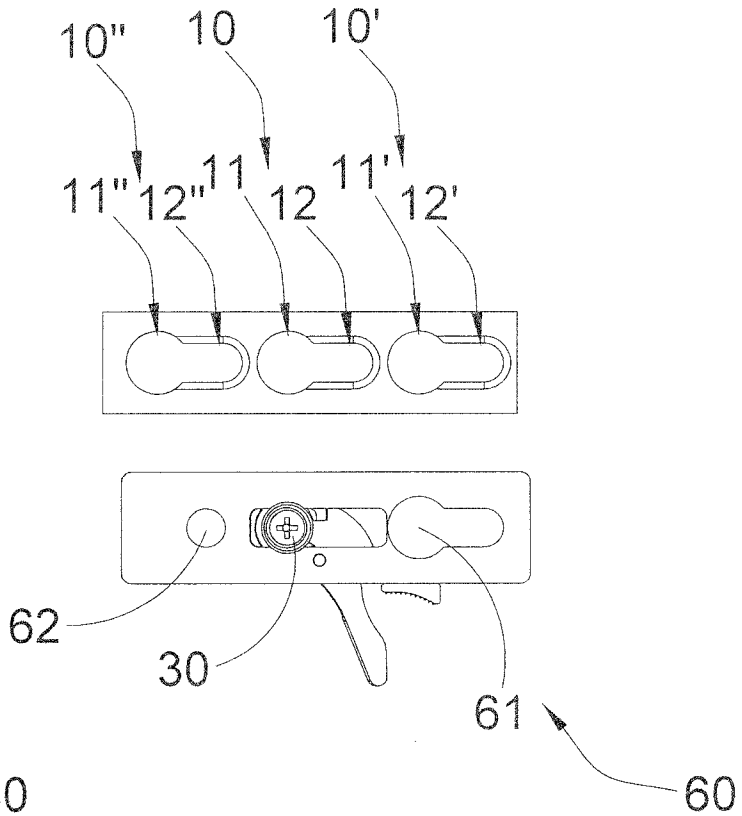
Figure 7B:
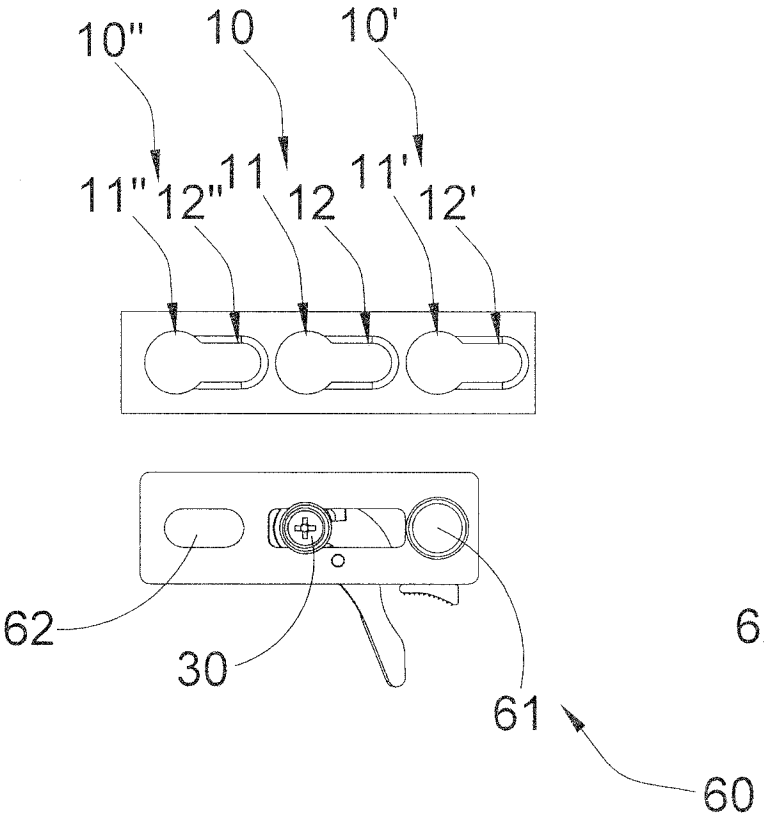
Figure 7E:
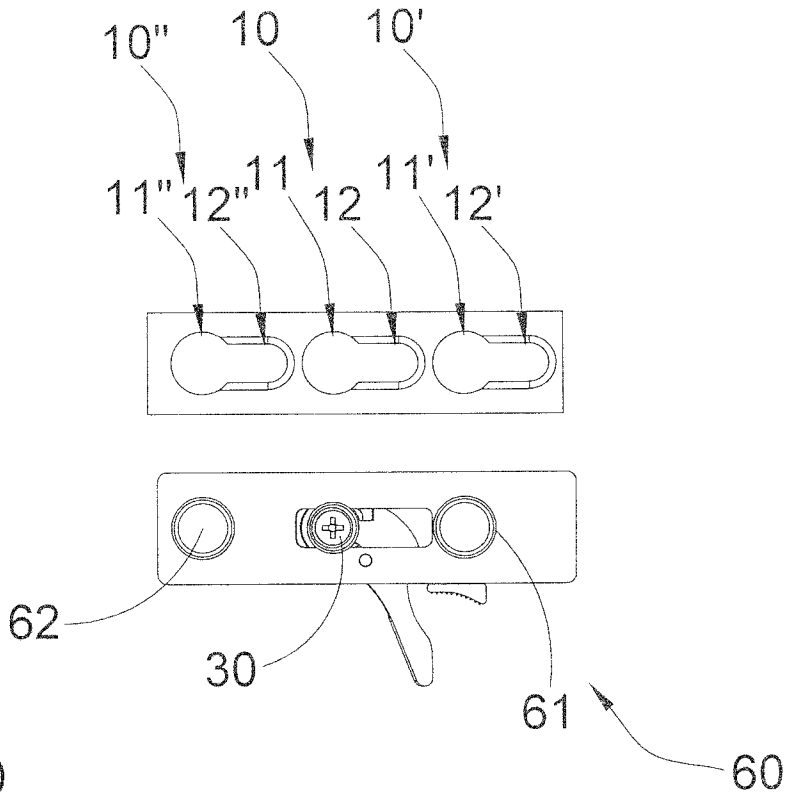
Figure 7D:
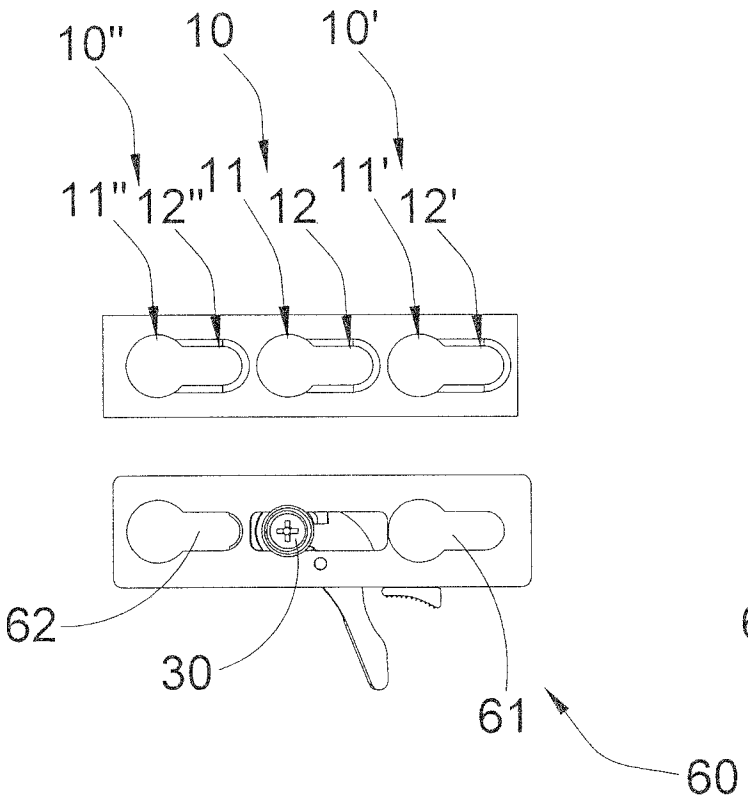

Preferably, the first positioning member 61 is sized and shaped with a keyhole configuration to match with the size and shape of the second mounting slot 10', as shown in FIG. 7. The second positioning member 62 has a curved engaging edge 621 adapted for engaging with the edge of the third mounting slot 10" at the narrower slot portion 12" thereof, as shown in FIG. 7. Alternatively, the first and second positioning members 61, 62 can be configured with different shapes corresponding to the shapes of the second and third mounting slots 10', 10", as shown in FIGS. 7A to 7G. For example, the size and shape of the first positioning member 61 can be configured to match with the enlarged slot portion 11' of the second mounting slot 10', as shown in FIGS. 7A, 7B, and 7E. The size and shape of the second positioning member 62 can be configured to match with the narrower slot portion 12" of the third mounting slot 10", as shown in FIG. 7B. The size and shape of the second positioning member 62 can be configured to match with the diameter size of the narrower slot portion 12" of the third mounting slot 10", as shown in FIG. 7C. Likewise, the sizes and shapes of the first and second positioning members 61, 62 are configured to have a keyhole configuration to match with the sizes and shapes of the second and third mounting slots 10', 10", as shown in FIG. 7D. Or, the size and shape of the second positioning member 62 can be configured to match with the diameter size of the enlarged slot portion 11" of the third mounting slot 10", as shown in FIG. 7E.

Figure 7G:
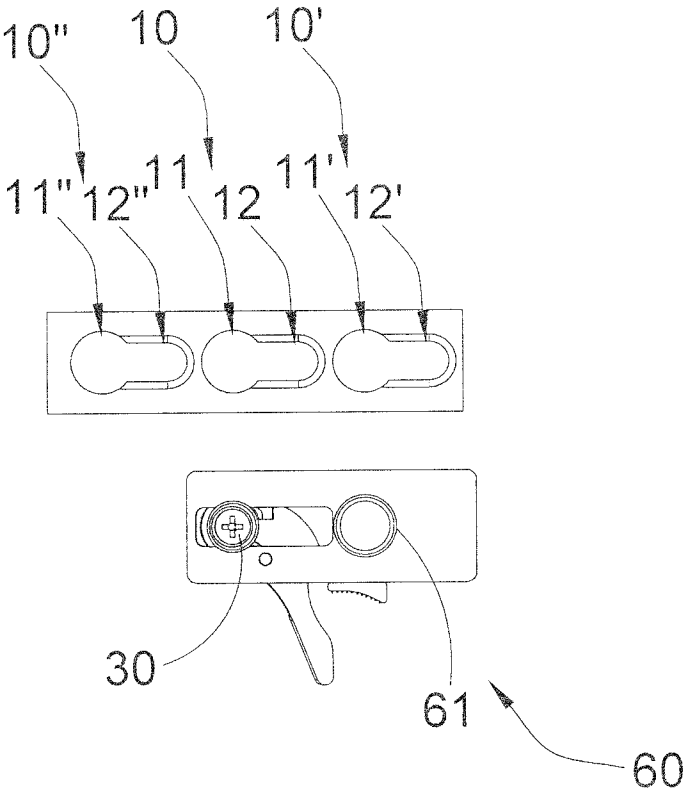
Figure 7F:
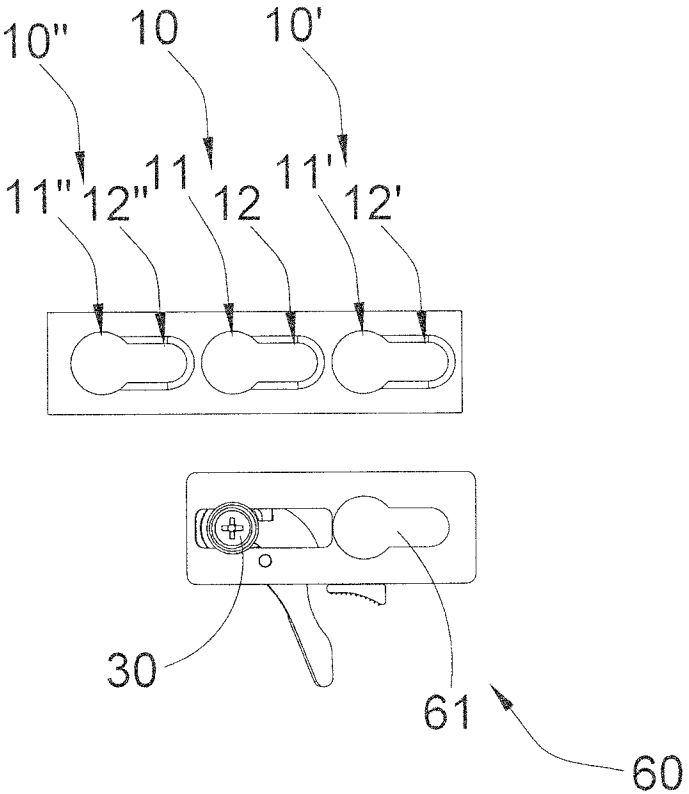

It is worth mentioning that only one positioning member 61 can be used to incorporate with the coupling head 30 while the second positioning member 62 could be optional. For example, the first positioning member 61 can be formed in keyhole configuration to incorporate with the coupling head 30, as shown in FIG. 7F, or the first positioning member 61 can be formed to match with the enlarged slot portion 11' of the second mounting slot 10' in order to incorporate with the coupling head 30, as shown in FIG. 7G.

Preferably, both the first and second positioning members 61, 62 are used to incorporate with the coupling head 30, such that the arrangement of the present invention provides a three-point support to prevent any unwanted longitudinal and/or rotational (twisting) movement of the accessory with respect to the firearm after the mounting body 20 is mounted to the firearm.

It is worth mentioning that since the coupling head 30 is locked in the releasing position, the first and second positioning members 61, 62 are automatically aligned with the second and third mounting slots 10', 10" respectively. In other words, in the releasing position, the distance between the coupling head 30 and the first positioning member 61, and the distance between the coupling head 30 and the second positioning member 62 will not be altered. As a result, once the head portion 31 of the coupling head 30 is aligned at the enlarged slot portion 11 of the mounting slot 10, the first and second positioning members 61, 62 will align with the second and third mounting slots 10', 10" respectively. This is the reason why the coupling head 30 should be locked and stationary in the releasing position.

Figure 8:
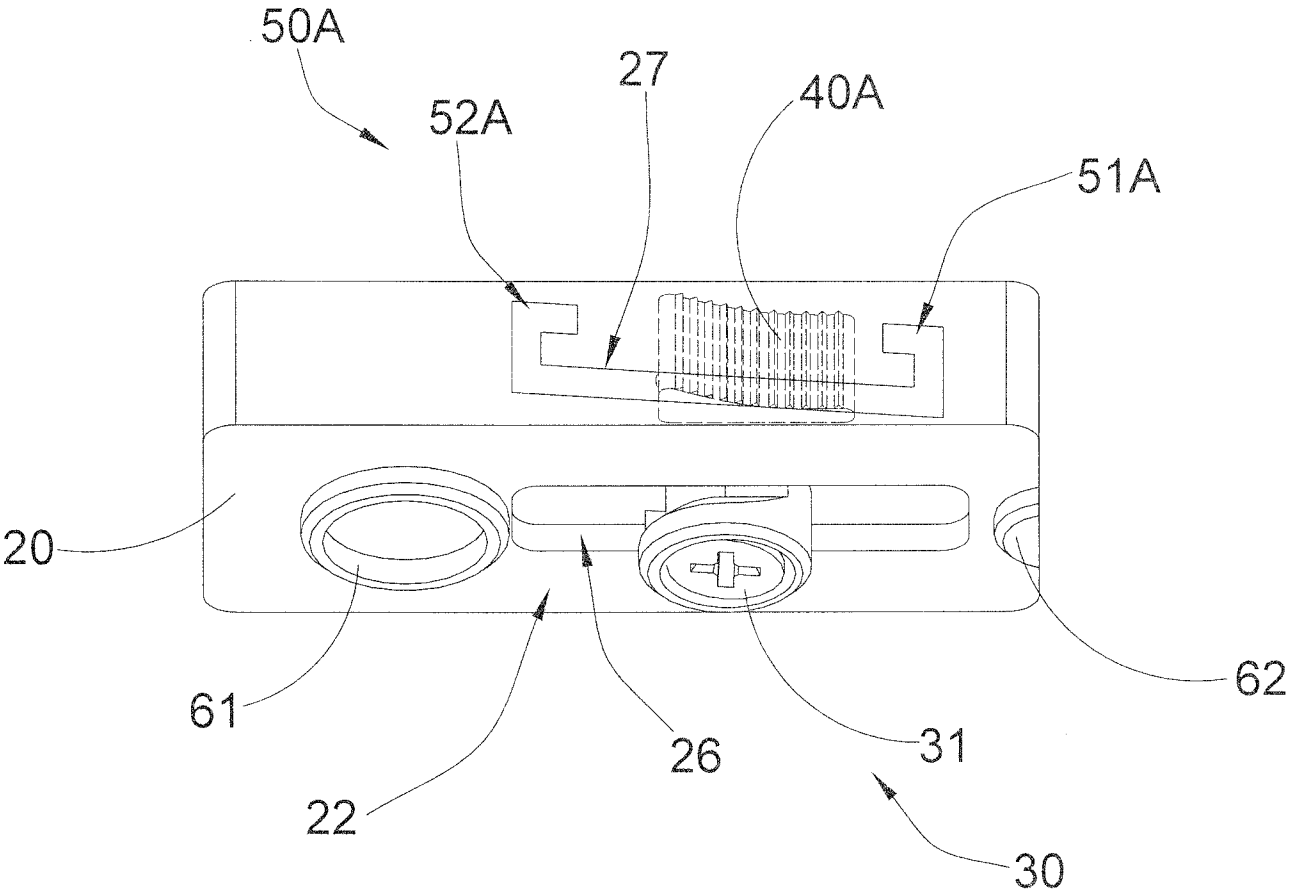
FIG. 8 illustrates a first alternative mode of the KeyMod quick mounting arrangement according to the above preferred embodiment of the present invention.
Figure 9:
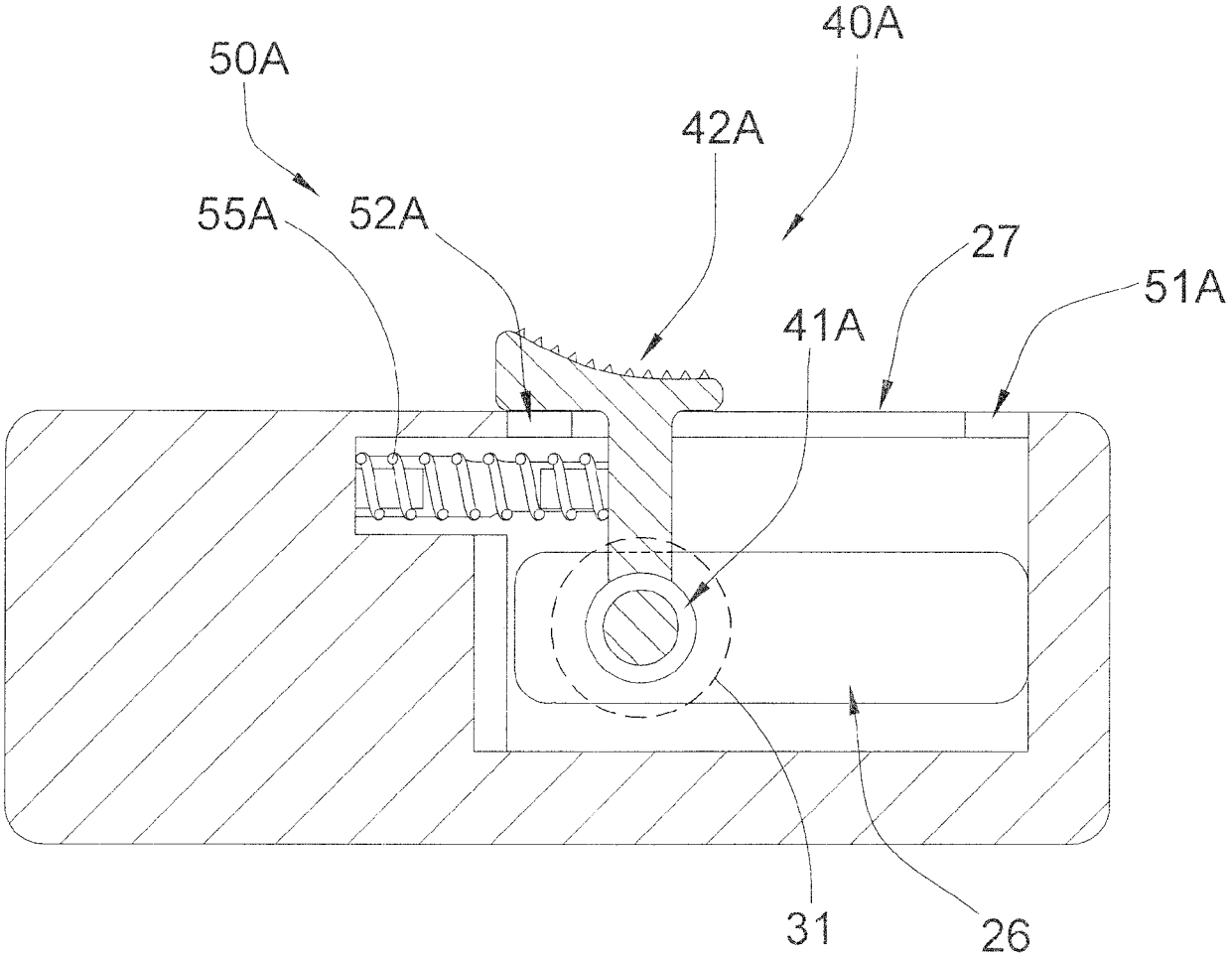
FIG. 9 is a sectional view of the first alternative mode of the KeyMod quick mounting arrangement according to the above preferred embodiment of the present invention.

FIGS. 8 and 9 illustrate a first alternative mode of the arrangement, wherein the actuating member 40A is slidably coupled at the mounting body 20 at the sliding channel 27. Accordingly, the actuating member 40A has a driving end 41A extended into the interior cavity of the mounting body 20 to couple at the coupling head 30 and an actuating end 42A extended out of the sidewall 23 of the mounting body 20 through the sliding channel 27. The driving end 41A of the actuating member 40A is affixed at the coupling head 30. Therefore, by actuating the actuating end 42A of the actuating member 40A to slide the actuating member 40A along the sliding channel 27, the driving end 41A of the actuating member 40A is correspondingly moved to drive the coupling head 30 between the releasing position and the securing position. In other words, the coupling head 30 is guided to move from the releasing position to the securing position in order to move the head portion 31 of the coupling head 30 toward the bottom side 22 of the mounting body 20 at the same time. It is worth mentioning that one single actuating action of the actuating member 40A will move the head portion 31 of the coupling head 30 being slid to the narrower slot portion 12 of the mounting slot 10 and being moved toward the second side 22 of the mounting head 20 at the same time for securing the accessory at the firearm.

It is appreciated that the actuating member 40A can be extended out of the interior cavity of the mounting body 20 through the front wall thereof, wherein the actuating member 40A can be pulled to move the coupling head 30 from the releasing position to the securing position and can be pushed to move the coupling head back to the releasing position from the securing position. Likewise, the actuating member 40A can be extended out of the interior cavity of the mounting body 20 through the rear wall thereof, wherein the actuating member 40A can be pushed to move the coupling head 30 from the releasing position to the securing position and can be pulled to move the coupling head back to the releasing position from the securing position. It is worth mentioning that, for the configuration of the actuating member 40A at the front or rear side of the mounting body 20, the sliding channel 27 can be formed as a rail supported in the interior cavity of the mounting to guide the head portion 31 of the coupling head 30 moving toward the bottom side 22 of the mounting body 20 when the coupling head 30 is moving in the securing position.

Furthermore, the locker unit 50A has first and second locking slots 51A, 52A transversely extended from two ends of the sliding channel 27 to form a U-shaped configuration. When the actuating member 40A is slid from the sliding channel 27 to the first locking slot 51A, the coupling head 30 is locked in the releasing position, and when the actuating member 40A is slid from the sliding channel 27 to the second locking slot 52A, the coupling head 30 is locked in the securing position.

The locker unit 50A further comprises a resilient element 55A supported within the interior cavity of the mounting body 20 for applying an urging force against the actuating member 40A. The resilient element 55A, according to the preferred embodiment, is a compression spring having two ends biased against the actuating member 40A and an inner wall of the interior cavity of the mounting body 20 to push the actuating member 40A toward the first locking slot 51A, so as to ensure the actuating member 40A to be engaged with the first locking slot 51A. Therefore, the user must intentionally slide the actuating member 40A along the sliding channel 27 from the first locking slot 51A by overcoming the spring force of the resilient element 55A in order to push the actuating member 40A toward the second locking slot 52A.

Figure 10:
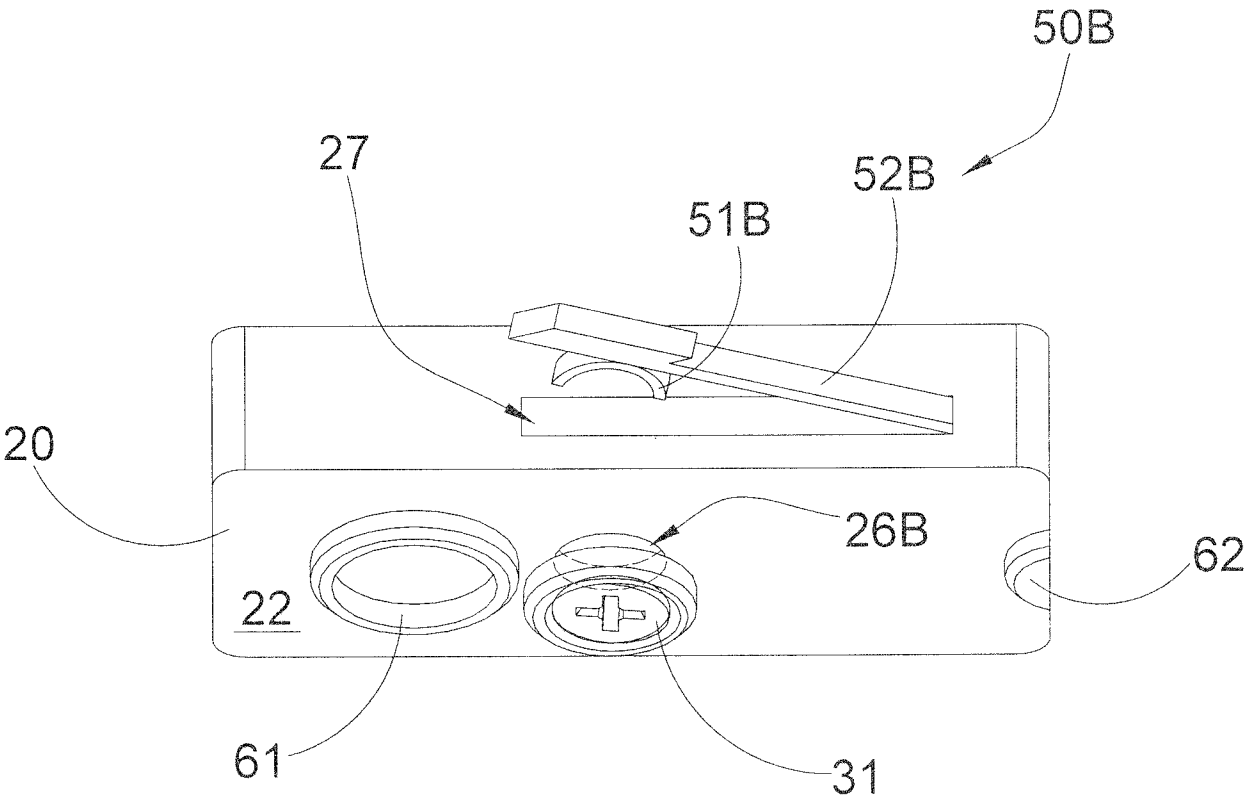
FIG. 10 illustrates a second alternative mode of the KeyMod quick mounting arrangement according to the above preferred embodiment of the present invention.
Figure 11:
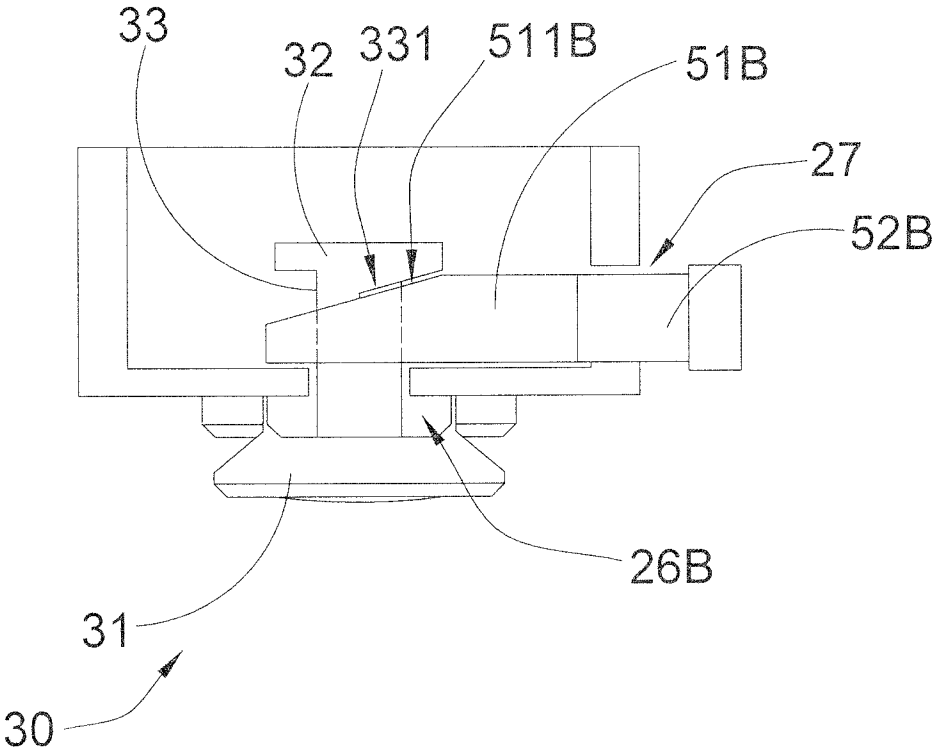
FIG. 11 is a sectional view of the second alternative mode of the KeyMod quick mounting arrangement according to the above preferred embodiment of the present invention.

FIGS. 10 and 11 illustrates a second alternative of the arrangement, wherein the guiding slot 26B is modified to have a circular hole configuration formed at the bottom side 22 of the mounting body 20. The diameter of the guiding slot 26B is slightly larger than a size of the neck portion 33 of the coupling head 30 and is smaller than a size of each of the retention portion 32 and the head portion 31 of the coupling head 30. Therefore, the coupling head 30 can only moved vertically at the guiding slot 26B but cannot move longitudinally with respect to the mounting head 20.

Accordingly, when the head portion 31 of the coupling head 30 is moved between the releasing position and the securing position, the mounting body 20 is correspondingly moved at the same direction. In other words, the coupling head 30 is locked in the releasing position via the guiding slot 26B to prevent the coupling head 30 being slid with respect to the mounting body 20.

The locker unit 50B is provided at the mounting body 20 for locking the coupling head 30 in the securing position. The locker unit 50B comprises a locking arm 52B pivotally coupled at the mounting body 20 and a locking latch 51B extended from the locking arm 52B to couple at the coupling head 30 in order to lock up the coupling head 30 in the securing position and to move the head portion 31 of the coupling 30 toward the bottom side 22 of the mounting body 20 at the same time.

As shown in FIG. 10, the locking arm 52B has a pivot end pivotally coupled at the mounting body 20 and an opposed movable end, wherein the locking arm 50B is pivotally movable at the sliding channel 27. The locking latch 51B generally has a U-shaped configuration integrally extended from the locking arm 52B, wherein when the movable end of the locking arm 52B is actuated, the locking latch 51B is extended into the interior cavity of the mounting body 20 through the sliding channel 27 and is engaged with the neck portion 33 of the coupling head 30 so as to move the head portion 31 of the coupling 30 toward the bottom side 22 of the mounting body 20. It is worth mentioning that the locking latch 51B is coupled at the coupling head 30 only when the coupling head 30 is moved in the securing position. Preferably, a first slanted surface 331 is formed at the neck portion 33 of the coupling head 30 and a second slanted surface 511B is formed at the locking latch 51B, such that when the locking latch 51B is engaged with the neck portion 33 of the coupling head 30, the second slanted surface 511B is engaged with the first slanted surface 331 to move the head portion 31 of the coupling 30 toward the bottom side 22 of the mounting body 20. Accordingly, the sliding channel 27 in this alternative can be an inclined channel or a horizontal channel formed at the sidewall 23 of the mounting body 20.

The present invention further provides a method of detachably mounting the accessory at the firearm via the arrangement of the present invention. For the configuration of the coupling head 30 capable of longitudinally moving with respect to the mounting body 20 via the guiding slot 26, the method comprises the following steps.

(1) Dispose the head portion 31 of the coupling head 30 at the enlarged slot portion 11 of the mounting slot 10. Accordingly, the coupling head 30 is locked and stationary at the releasing position by the locker unit 50, such that the user is able to easily align the head portion 31 of the coupling head 30 with the enlarged slot portion 11 of the mounting slot 10. At the same time, the first and second positioning members 61, 62 are automatically aligned with the second and third mounting slots 10', 10" respectively.

(2) Slidably move the head portion 31 of the coupling head 30 from the enlarged slot portion 11 of the mounting slot 10 to the narrower slot portion 12 thereof so as to move the coupling head 30 from the releasing position to the securing position. It is worth mentioning that the mounting body 20 is stationary when the coupling head 30 is moved from the releasing position to the securing position along the guiding slot 26.

Accordingly, the coupling head 30 is moved by the actuating member 40. Preferably, when the actuating member 40 is pivotally actuated, the head portion 31 of the coupling head 30 not only moves to the narrower slot portion 12 of the mounting slot 10 but also moves toward the bottom side 22 of the mounting body 20. Therefore, the surrounding wall around the mounting slot 10 is clamped between the head portion 31 of the coupling head 30 and the bottom side 22 of the mounting body 20.

Alternatively, the coupling head 30 is moved by the actuating member 40A, wherein the actuating member 40A is slid along the sliding channel 27 to move the coupling head 30 between the releasing position and the securing position.

(3) Lock up the coupling head 30 in the securing position via the locker unit 50. As a result, the accessory at first side 21 of the mounting body 20 can be securely mounted to the firearm.

In order to detach the accessory from the firearm, the user is able to unlock the coupling head 30 at the securing position via the locker unit 50 and move the head portion 31 of the coupling head 30 back to the enlarged slot portion 11 of the mounting slot 10 from the narrower slot portion 12 thereof. Therefore, the mounting body 20 can be detached from the firearm once the head portion 31 of the coupling head 30 is disengaged from the enlarged slot portion 11 of the mounting slot 10.

The locking/unlocking operation of the arrangement comprises the following steps.

(A) Unlock the coupling head 30 in the releasing position to enable the coupling head 30 to move from the releasing position to the securing position. Accordingly, the coupling head 30 is normally locked up in the releasing position. In particular, the locking latch 51 is engaged with the first locking edge 52 at the actuating member 40 to retain the coupling head 30 in a stationary manner. Therefore, the head portion 31 of the coupling head 30 can be easily disposed at the enlarged slot portion 11 of the mounting slot 10.

The locking latch 51 is moved until the locking latch 51 is disengaged with the first locking edge 52 at the actuating member 40. Once the engagement between the locking latch 51 and the first locking edge 52 is released, the coupling head 30 can be moved from the releasing position to the securing position via the actuating arm 40.

Alternatively, the actuating member 40A is engaged with the first locking slot 51A to retain the coupling head 30 in a stationary manner and to lock up the coupling head 30 in the releasing position. The actuating member 40A is moved from the first locking slot 51A to the sliding channel 27 in order to unlock the coupling head 30 in the releasing position, such that the coupling head 30 can be moved from the releasing position to the securing position via the actuating arm 40A.

(B) Slidably move the head portion 31 of the coupling head 30 from the enlarged slot portion 11 of the mounting slot 10 to the narrower slot portion 12 thereof so as to move the coupling head 30 from the releasing position to the securing position.

(C) Lock up the coupling head 30 in the securing position. Accordingly, the locking latch 51 is engaged with the second locking edge 53 at the actuating member 40 to lock up the coupling head 30 in the securing position. It is worth mentioning that via the spring force of the resilient element 55, the locking latch 51 is pushed to automatically engage with the second locking edge 53, so as to ensure the coupling head 30 to be locked in the securing position.

In order to unlock the coupling head 30 in the securing position, the locking latch 51 is moved until the locking latch 51 is disengaged with the second locking edge 53. Therefore, the coupling head 30 can be moved back in the releasing position via the actuating member 40. Likewise, the spring force of the resilient element 55 will push the locking latch 51 to automatically engage with the first locking edge 52, so as to ensure the coupling head 30 to be locked in the releasing position.

Alternatively, when the actuating member 40A is slid from the sliding channel 27 to the second locking slot 52A, the coupling head 30 is locked in the securing position. In order to unlock the coupling head 30 in the securing position, the actuating member 40A is moved from the second locking slot 52A back to the sliding channel 27, so as to enable the coupling head 30 to be moved back to the releasing position.

For the configuration of the coupling head 30 capable of only moving in a vertical direction with respect to the mounting body 20 via the guiding slot 26B, the method comprises the following steps.

(1) Dispose the head portion 31 of the coupling head 30 at the enlarged slot portion 11 of the mounting slot 10.

(2) Slidably move the head portion 31 of the coupling head 30 from the enlarged slot portion 11 of the mounting slot 10 to the narrower slot portion 12 thereof so as to move the coupling head 30 from the releasing position to the securing position. It is worth mentioning that the mounting body 20 is moved to drive the coupling head 30 moving from the releasing position to the securing position.

Accordingly, when the head portion 31 of the coupling head 30 is moved in the securing position, the first and second positioning members 61, 62 are automatically aligned with the second and third mounting slots 10', 10" respectively.

(3) Lock up the coupling head 30 in the securing position via the locker unit 50. Accordingly, when the locking arm 5B is actuated, the locking latch 51B is driven to engage with the neck portion 33 of the coupling head 30 so as to lock up the coupling head 30 in the securing position and to move the head portion 31 of the coupling 30 toward the bottom side 22 of the mounting body 20 at the same time.

It is worth mentioning that the arrangement according to the preferred embodiment and their alternatives are interchangeable such that the user is able to detachably mount the accessory to the firearm. For example, the coupling head 30 can be moved by the actuating member 40 or the actuating member 40A while the coupling head 30 is locked by the locking latch 51B. The actuating member 40, 40A can be incorporated with any wall of the mounting body 20 except the first and second sides 21, 22 thereof.

Figure 12:
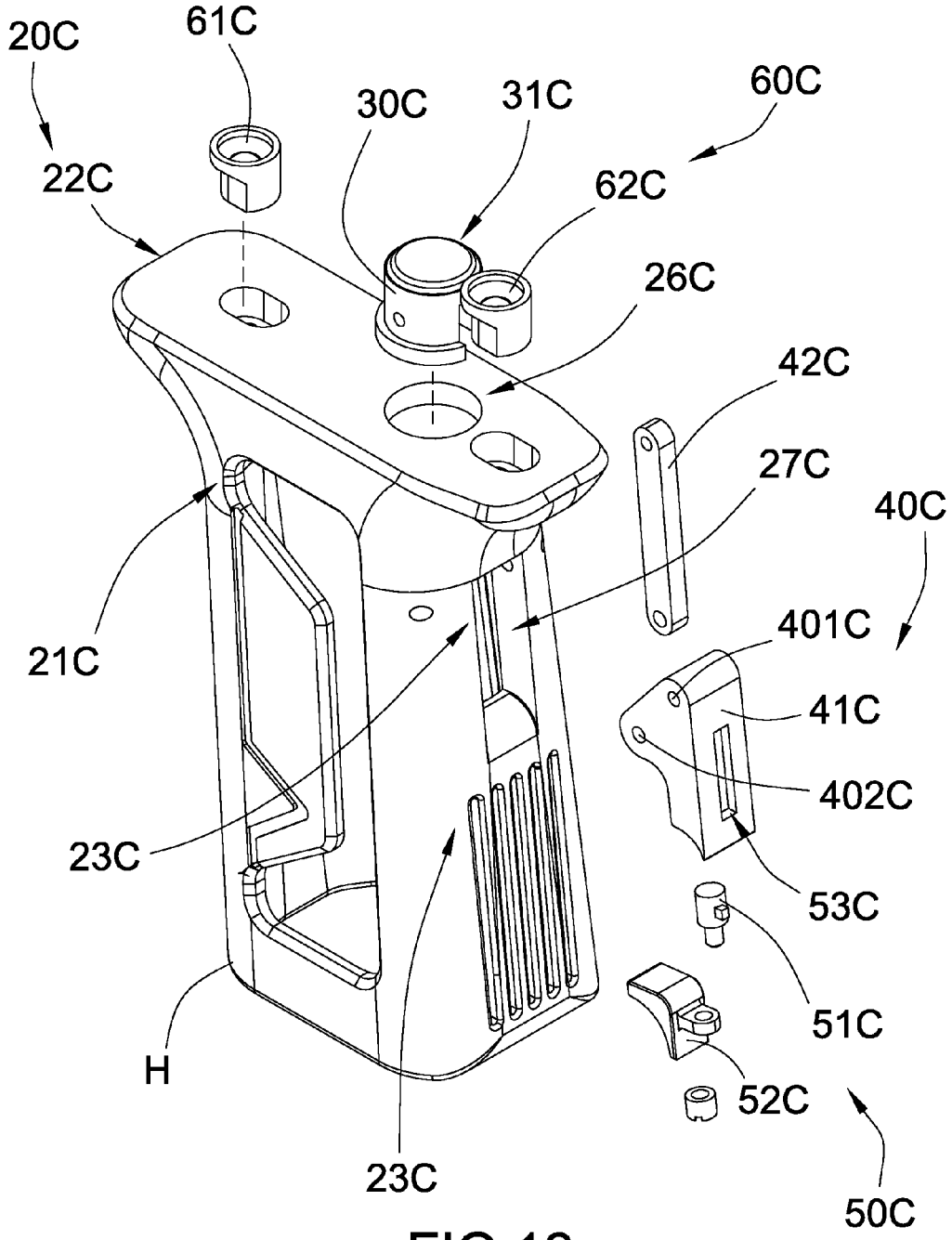
FIG. 12 is an exploded perspective view of a KeyMod quick mounting arrangement according to a second preferred embodiment of the present invention.

As shown in FIG. 12, a KeyMod quick mounting arrangement according to a second embodiment of the present invention is illustrated as an alternative mode of the first embodiment. The arrangement according to the second embodiment is arranged for detachably coupling an accessory at a firearm having one or more KeyMod mounting slots 10. For example, a hand grip is provided on the arrangement, as shown in FIG. 12, to detachably couple at the firearm.

According to the second embodiment, the KeyMod quick mounting arrangement comprises a mounting body 20C, a positioning unit 60C, and a coupling head 30C.

The mounting body 20C has a first side 21C adapted for extending from the accessory to be detachably coupled with the firearm, and an opposed second side 22C for coupling with the firearm at the mounting slot 10 via the coupling head 30C. As shown in FIG. 2, the hand grip H, having a hollow structure, is integrally extended from the first side 21C of the mounting body 20C, wherein the hand grip H can be detachably coupled to the bottom side of the firearm when the arrangement of the present invention is coupled to the mounting slot 10 at the bottom side of the firearm.

The mounting body 20C further has a sidewall 23C between the first and second sides 21C, 22C, and forms a low profile configuration to minimize a distance between the first and second sides 21C, 22C so as to minimize the distance between the accessory and the firearm. Accordingly, the side surface of the hand grip H can be integrally extended from the sidewall 23 of the mounting body 20C.

The positioning unit 60C comprises a positioning member 61C protruded from the second side 22C of the mounting body 20C for detachably engaging with the narrow slot portion 12 of the mounting slot 10. In particular, the positioning member 61C is upwardly protruded from the second side 22C of the mounting body 20C, as the orientation shown in FIGS. 13, 14 and 16, for slidably engaging with the narrow slot portion 12 of the mounting slot 10 from the enlarged slot portion 11 thereof. In other words, the positioning member 61C is initially disposed at the enlarged slot portion 11 and is then slid to the narrow slot portion 12 of the mounting slot 10 in order to engage the positioning member 61C with the mounting slot 10.

Figure 16:
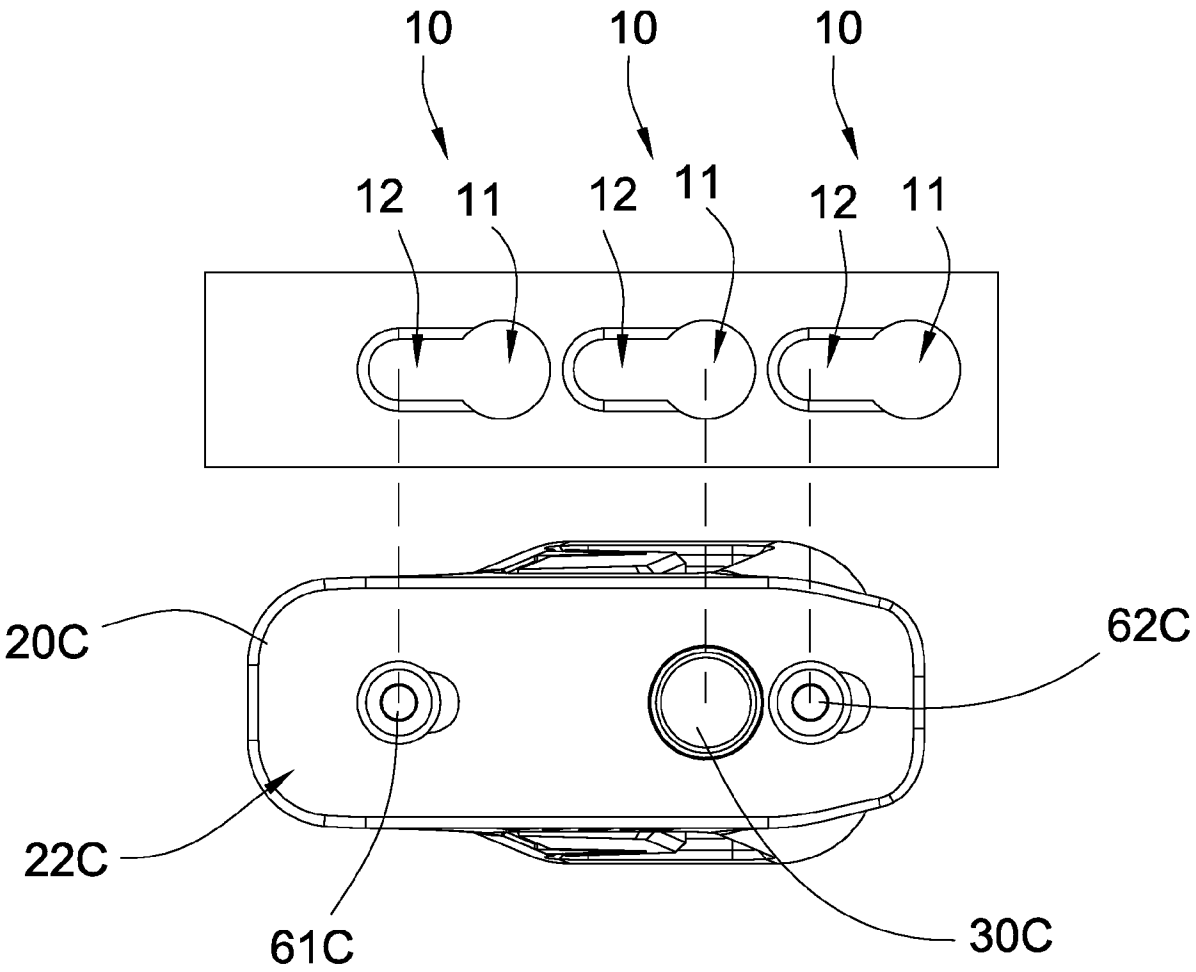
FIG. 16 is a top view of the KeyMod quick mounting arrangement according to the second preferred embodiment of the present invention, illustrating the arrangement mounted to the mounting slots to provide a three-point support.

The positioning unit 60C further comprises a second positioning member 62C protruded from the second side 22C of the mounting body 20C at a position adjacent to the coupling head 30C. The first and second positioning member 61C, 62C are identical and are sized and shaped with a keyhole configuration to match with the size and shape of the narrow slot portion 12 of the mounting slot 10. In particular, the first and second positioning members 61C, 62C are upwardly protruded from the second side 22C of the mounting body 20C and are aligned at a centerline of the second side 22C of the mounting body 20C, wherein the coupling head 30C is positioned between the two positioning members 61C, 62C. Preferably, the first and second positioning members 61C, 62C are engaged with different mounting slots 10. For example, the first and second positioning members 61C, 62C are engaged with the first and third mounting slots 10 respectively as shown in FIG. 16.

Each of the first and second positioning members 61C, 62C has an enlarged head portion and an elongated neck portion upwardly extended from the second side 22C of the mounting body 20C to the enlarged head portion. A size of the enlarged head portion of each of the first and second positioning members 61C, 62C is slightly larger than a width of the narrow slot portion 12 of the mounting slot 10, and a size of the elongated neck portion of each of the first and second positioning members 61C, 62C is slightly smaller than the width of the narrow slot portion 12 of the mounting slot 10.

Therefore, each of the first and second positioning members 61C, 62C can be slid to a far edge of the narrow slot portion 12 of the mounting slot 10 from the enlarged slot portion 11 thereof in order to engage with the narrow slot portion 12. In particular, the enlarged head portion of each of the first and second positioning members 61C, 62C is arranged for sliding above the narrow slot portion 12 of the mounting slot 10 to engage the enlarged head portion of each of the first and second positioning members 61C, 62C with the slanted surface of the mounting slot 10 so as to secure the mounting body 20C on the bottom side of the mounting slot 10. Accordingly, each of the first and second positioning members 61C, 62C further has a slanted engaging surface formed at the enlarged head portion to slidably engage with the narrow slot portion 12 of the mounting slot 10 with the chamfered configuration.

According to the second embodiment, the coupling head 30C is movably extended from the mounting body 20C between a releasing position and a securing position. The coupling head 30C has a head portion 31C outwardly protruded from the second side 22C of the mounting body 20C. In the securing position, the head portion 31C of the coupling head 30C is arranged for being disposed in the enlarged slot portion 11 of the mounting slot 10 so as to secure the accessory at the firearm. In the releasing position, the head portion 31C of the coupling head 30C is arranged for disengaging with the enlarged slot portion 11 of the mounting slot 10 so as to enable the accessory to be detached from the firearm.

In particular, the coupling head 30C is slidably coupled at the mounting body 20C preferably in a vertically movable manner. Therefore, in the securing position, the head portion 31C of the coupling head 30C is slidably protruded from the second side 22C of the mounting body 20C for being disposed in the enlarged slot portion 11 of the mounting slot 10. In other words, the top side of the head portion 31C of the coupling head 30C is protruded above the second side 22C of the mounting slot 10 in the securing position. In the releasing position, the head portion 31C of the coupling head 30C is slid back to align with the second side 22C of the mounting body 20C for disengaging with the enlarged slot portion 11 of the mounting slot 10. In other words, the top side of the head portion 31C of the coupling head 30C is located at the same level or below the second side 22C of the mounting slot 10 in the releasing position.

Figure 13:
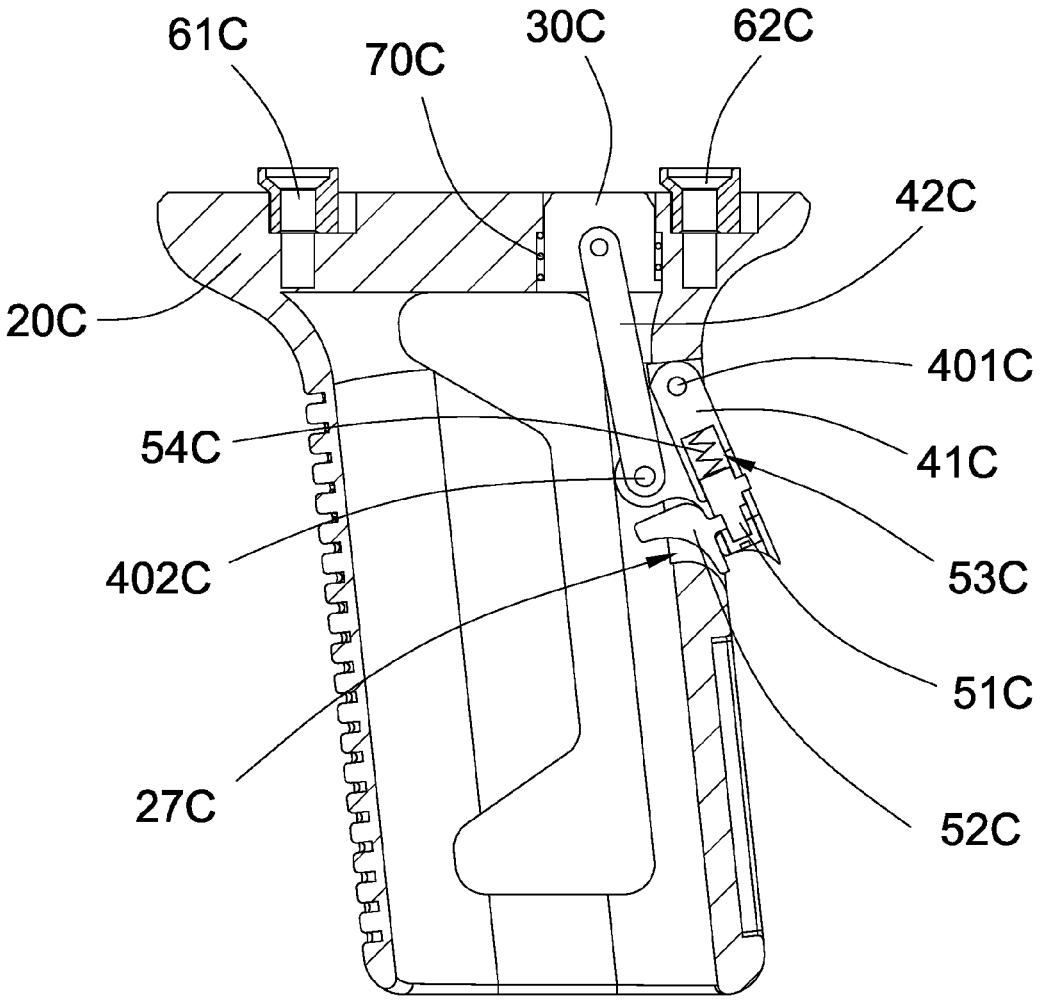
FIG. 13 is a sectional view of the KeyMod quick mounting arrangement according to the second preferred embodiment of the present invention, illustrating the coupling head in the releasing position.
Figure 14:
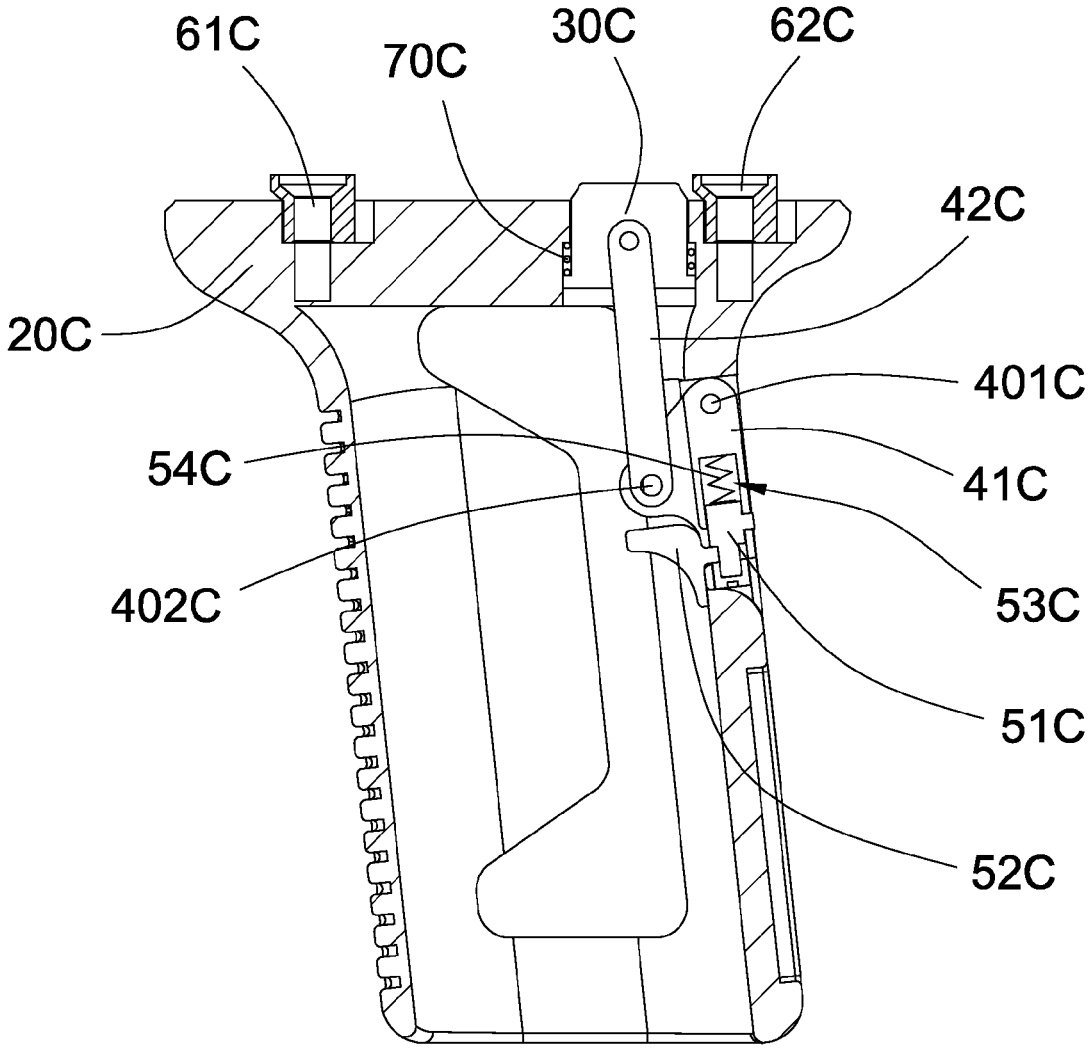
FIG. 14 is a sectional view of the KeyMod quick mounting arrangement according to the second preferred embodiment of the present invention, illustrating the coupling head in the securing position.

As shown in FIGS. 13, 14 and 16, the coupling head 30C is located between and is aligned with the first and second positioning members 61C, 62C. Preferably, after the first and second positioning members 61C, 62C are slidably engaged with the narrow slot portions 12 of the first and second mounting slots 10 respectively, the head portion 31C of the coupling head 30C is slidably protruded to engage with the enlarged slot portion 11 of the second mounting slot 10. The second mounting slot 10 is located between and is aligned with the first and third mounting slots 10 end-to-end. Therefore, the arrangement of the present invention provides a three-point support to prevent any unwanted longitudinal and/or rotational (twisting) movement of the accessory with respect to the firearm after the mounting body 20C is mounted to the firearm, as shown in FIG. 16.

In order to guide the sliding movement of the coupling head 30C, the mounting body 20C further has a sliding slot 26C indently formed on the second side 22C of the mounting body 20C, wherein the coupling head 30C is slidably disposed at the sliding slot 26C to guide the coupling head 30C to slide between the securing position and the releasing position. Preferably, the sliding slot 26C is a through slot extended from the second side 22C of the mounting body 20C to the first side 21C thereof.

Figure 15:
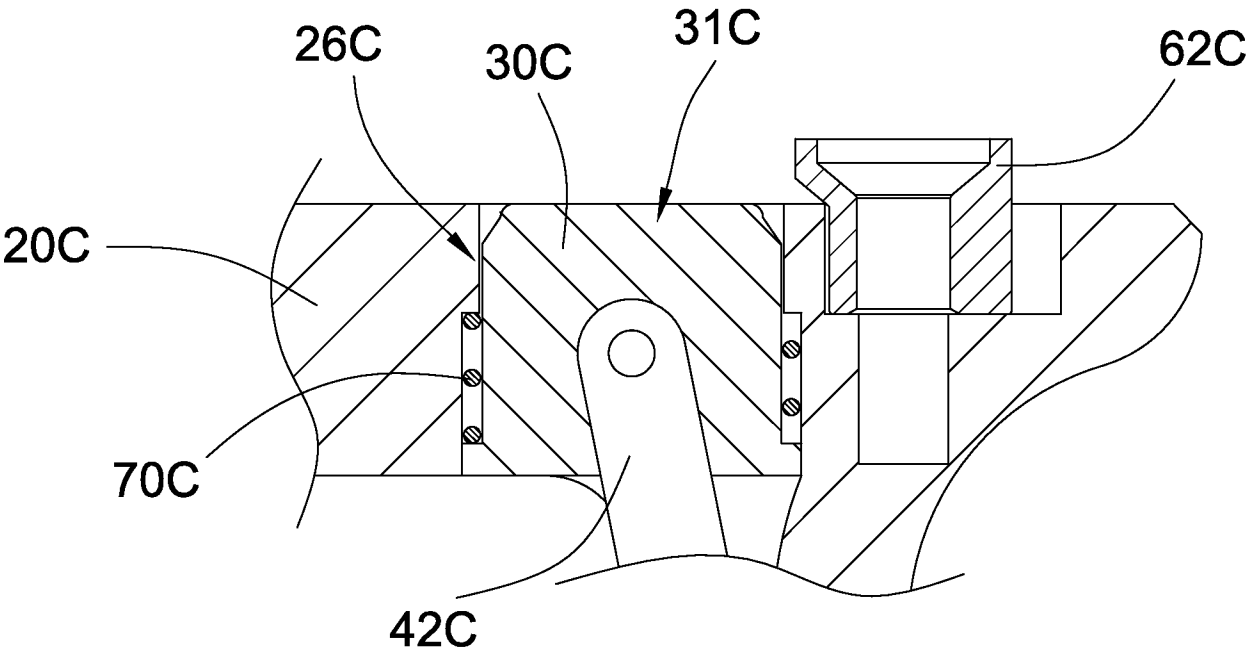
FIG. 15 is a sectional view of the coupling head of the KeyMod quick mounting arrangement according to the second preferred embodiment of the present invention, illustrating the tapered shape of the coupling head with the resilient element.

As shown in FIG. 15, the head portion 31C of the coupling head 30C has a tapered circumferential surface that a circumferential size of the head portion 31C is gradually reducing from bottom to top. Therefore, in the securing position, the tapered circumferential surface of the head portion 31C of the coupling head 30C is arranged for biasing against a rim of the enlarged slot portion 11 of the mounting slot 10. It is worth mentioning that the tapered shaped head portion 31C of the coupling head 30C will match with the size of the enlarged slot portion 11 of the mounting slot 10 when the head portion 31C of the coupling head 30C is slidably protruded to engage with the enlarged slot portion 11 of the second mounting slot 10, so as to prevent any unwanted movement between the mounting body 20C and the firearm.

The KeyMod quick mounting arrangement further comprises a resilient element 70C supported in the sliding slot 26C for biasing against the coupling head 30C to normally push the coupling head 30C from the securing position to the releasing position, so as to ensure the coupling head 30C to be normally retained at the releasing position. As shown in FIG. 15, the resilient element 70C is a compression spring coaxially disposed in the sliding slot 26C, wherein the resilient element 70C has an upper end biased against an inner wall ridge of the sliding slot 26C and a bottom end biased against an outer wall ridge of the coupling head 30C. Therefore, the resilient element 70C will apply a downward pushing force against the coupling head 30C to push the coupling head 30C down from the securing position to the releasing position. In other words, the coupling head 30C will be normally retained in the releasing position via the resilient element 70C.

According to the second embodiment, the KeyMod quick mounting arrangement further comprises an actuating unit 40C for moving the coupling head 30C between the securing position and the releasing position. The actuating unit 40C comprises an actuating member 41C pivotally coupled at the sidewall 23C of the mounting body 20C. The actuating member 41C is actuated to push the head portion 31C of the coupling head 30C to be protruded from the second side 22C of the mounting body 20C in the securing position. The actuating member 41C is also actuated to pull the head portion 31C of the coupling head 30C back to the second side 22C of the mounting body 20C in the releasing position.

As shown in FIGS. 12 to 14, the mounting body 20C further has an actuating slot 27C formed at the sidewall 23C of the mounting body 20C, wherein the actuating member 41C is pivotally coupled at the sidewall 23C of the mounting body 20C within the actuating slot 27C.

The actuating member 41C is pivotally coupled at the mounting body 20C to define a pivot point 401C thereat. The actuating member 41C has a pivot end pivotally coupled at the mounting body 20C at the pivot point 401C and a folding end to drive the actuating member 41C in a pivotal movement at the pivot point 401C. Accordingly, when the folding end of the actuating member 41C is folded toward the sidewall 23C of the mounting body 20C, the coupling head 30C is moved in the securing position. When the folding end of the actuating member 41C is folded away from the sidewall 23C of the mounting body 20C, the coupling head 30C is moved in the releasing position.

The actuating unit 40C further comprises a transmission arm 42C for transmitting the pivotal movement of the actuating member 41C to a linear movement of the coupling head 30C. Accordingly, the transmission arm 42C has two ends pivotally coupled at the coupling head 31C and the actuating member 41C respectively. The first end (upper end) of the transmission arm 42C is pivotally coupled at a bottom portion of the coupling head 31C. The second end (lower end) of the transmission arm 42C is pivotally coupled at the actuating member 41C to define a second pivot point 402C. Preferably, the first pivot point 401C is located above the second pivot point 402C.

Accordingly, when the actuating member 41C is pivotally moved toward the sidewall 23C of the mounting body 20C, the transmission arm 42C is pivotally actuated to push the head portion 31C of the coupling head 30C in the securing position, and when the actuating member 41C is pivotally moved away from the sidewall 23C of the mounting body 20C, the transmission arm 42C is pivotally actuated to pull the head portion 31C of the coupling head 30C in the releasing position.

In other words, when the folding end of the actuating member 41C is folded toward the sidewall 23C of the mounting body 20C, the transmission arm 42C is driven to move upwardly so as to push the coupling head 30C upwardly in the securing position. Preferably, the actuating member 41C is folded flat on the sidewall 23C of the mounting body 20C and is received within the actuating slot 27C when the coupling head 30C is moved in the securing position.

When the folding end of the actuating member 41C is folded away from the sidewall 23C of the mounting body 20C, the transmission arm 42C is driven to move downwardly so as to pull the coupling head 30C downwardly in the releasing position. In other words, the coupling head 30C is driven to reciprocatingly move within the sliding slot 26C in a piston movement.

It is worth mentioning that when the user grips the hand grip as the accessory of the firearm, the hand of the user will tightly push the folding end of the actuating member 41C toward the sidewall 23C of the mounting body 20C, so as to ensure the coupling head 30C to be moved in the securing position when the hand grip is held by the user's hand.

The KeyMod quick mounting arrangement further comprises a locker unit 50C for releasably locking the coupling head 30C in the securing position. According to the second embodiment, the locker unit 50C is arranged to lock up the actuating member 41C at the sidewall 23C of the mounting body 20C in order to lock up the coupling head 30C in the securing position.

Accordingly, the locker unit 50C comprises a releasable switch 51C movably coupled at the actuating member 41C and a locking latch 52C actuated by the releasable switch 51C to releasably engage with the sidewall 23C of the mounting body 20C. As shown in FIGS. 13 and 14, the locking unit 50C further has a locker slot 53C formed at the actuating member 41C and extended to the folding end of the actuating member 41C, wherein the releasable switch 51C is slidably disposed at the locker slot 53C. The locking latch 52C is extended from the releasable switch 51C to an inner side of the sidewall 23C of the mounting body 20C.

When the folding end of the actuating member 41C is folded toward the sidewall 23C of the mounting body 20C, the locking latch 52C is moved to engage with an inner surface of the sidewall 23C of the mounting body 20C to lock up the actuating member 41C at the sidewall 23C of the mounting body 20C, so as to lock up the coupling head 30C in the securing position.

When the releasable switch 51C is slidably and upwardly moved at the locker slot 53C, i.e. the releasable switch 51C is moved toward the pivot end of the actuating member 41C from the folding end thereof, the locking latch 52C is driven to disengage with the inner surface of the sidewall 23C of the mounting body 20C. Therefore, the folding end of the actuating member 41C is allowed to pivotally move away from the sidewall 23C of the mounting body 20C so as to move the coupling head 30C from the securing position to the releasing position.

Preferably, the locker unit 50C further comprises a locker spring 54C disposed in the locker slot 53C for applying a pushing force against the releasable switch 51C to push the releasable switch 51C toward the folding end of the actuating member 41C so as to ensure the locking latch 52C to be engaged with the inner surface of the sidewall 23C of the mounting body 20C once the folding end of the actuating member 41C is folded toward the sidewall 23C of the mounting body 20C. In other words, in order to unlock the locking latch 52C, the releasable switch 51C must be moved to against the force generated by the locker spring 54C. It is worth mentioning that the bottom edge of the actuating slot 27C has a curved surface to enable the locking latch 52C to slide thereon in order to engage with the inner surface of the sidewall 23C of the mounting body 20C.

Figure 17:
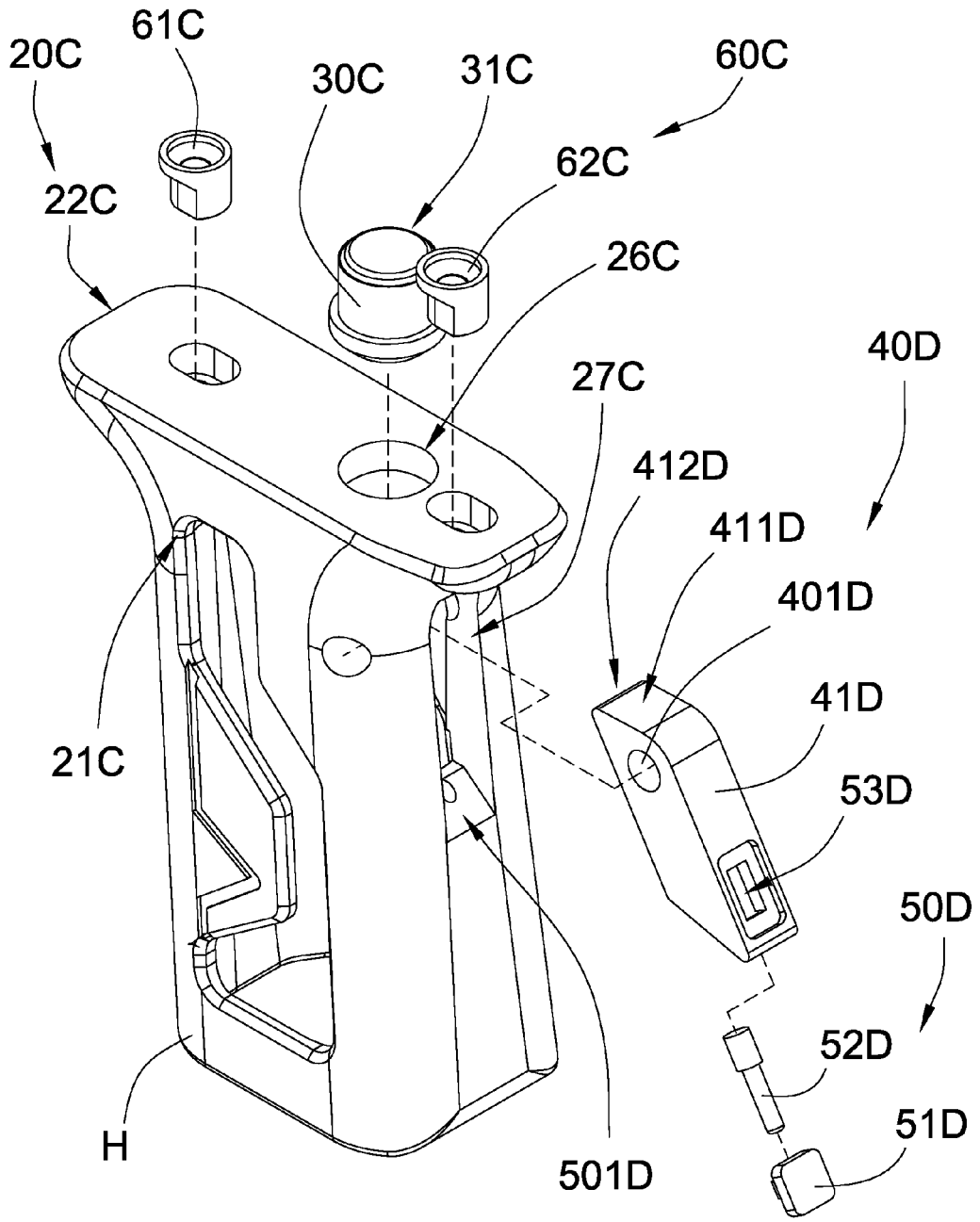
FIG. 17 illustrates a first alternative mode of the KeyMod quick mounting arrangement according to the second preferred embodiment of the present invention.
Figure 18:
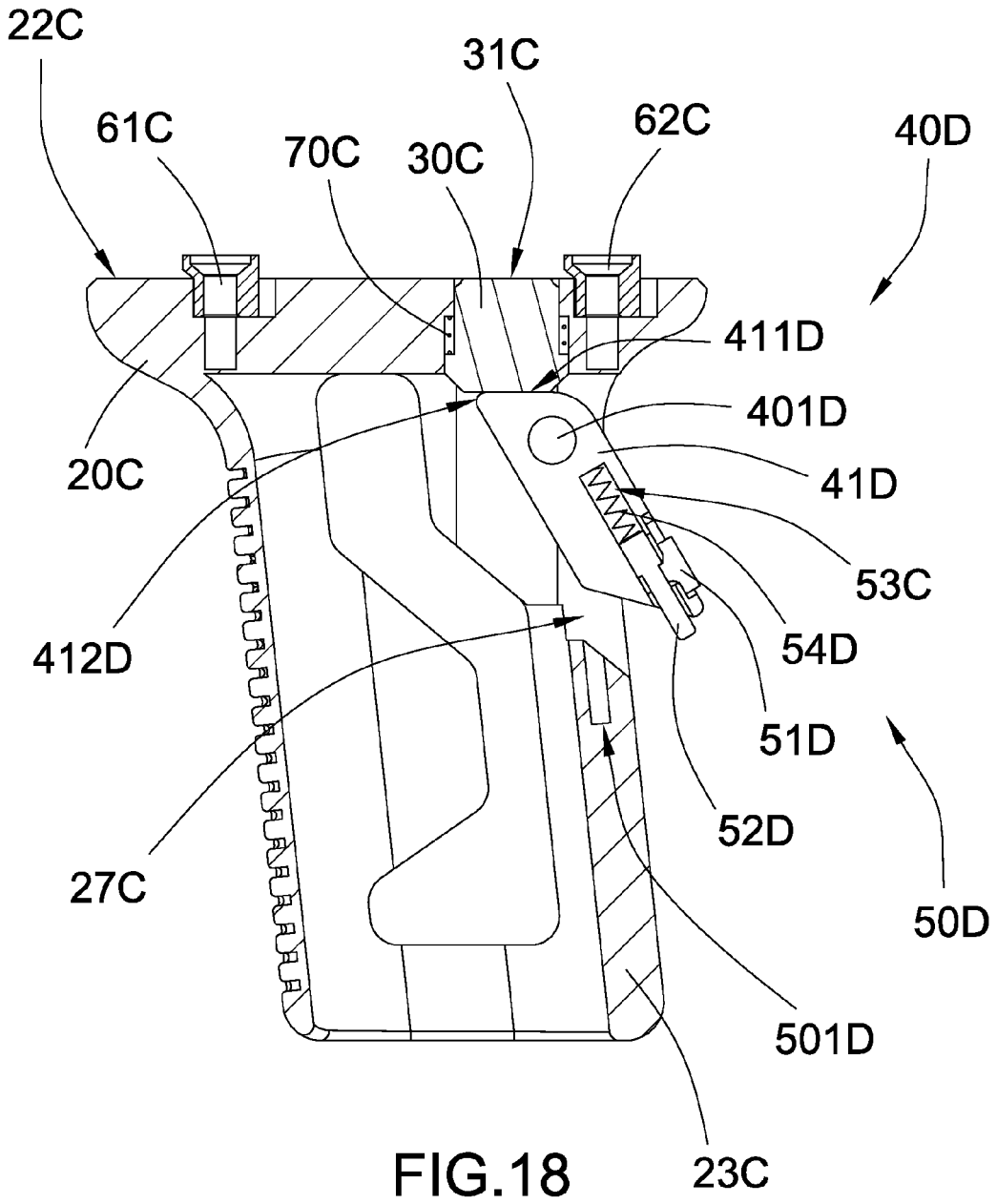
FIG. 18 is a sectional view of the first alternative mode of the KeyMod quick mounting arrangement according to the second preferred embodiment of the present invention, illustrating the coupling head in the releasing position.
Figure 19:
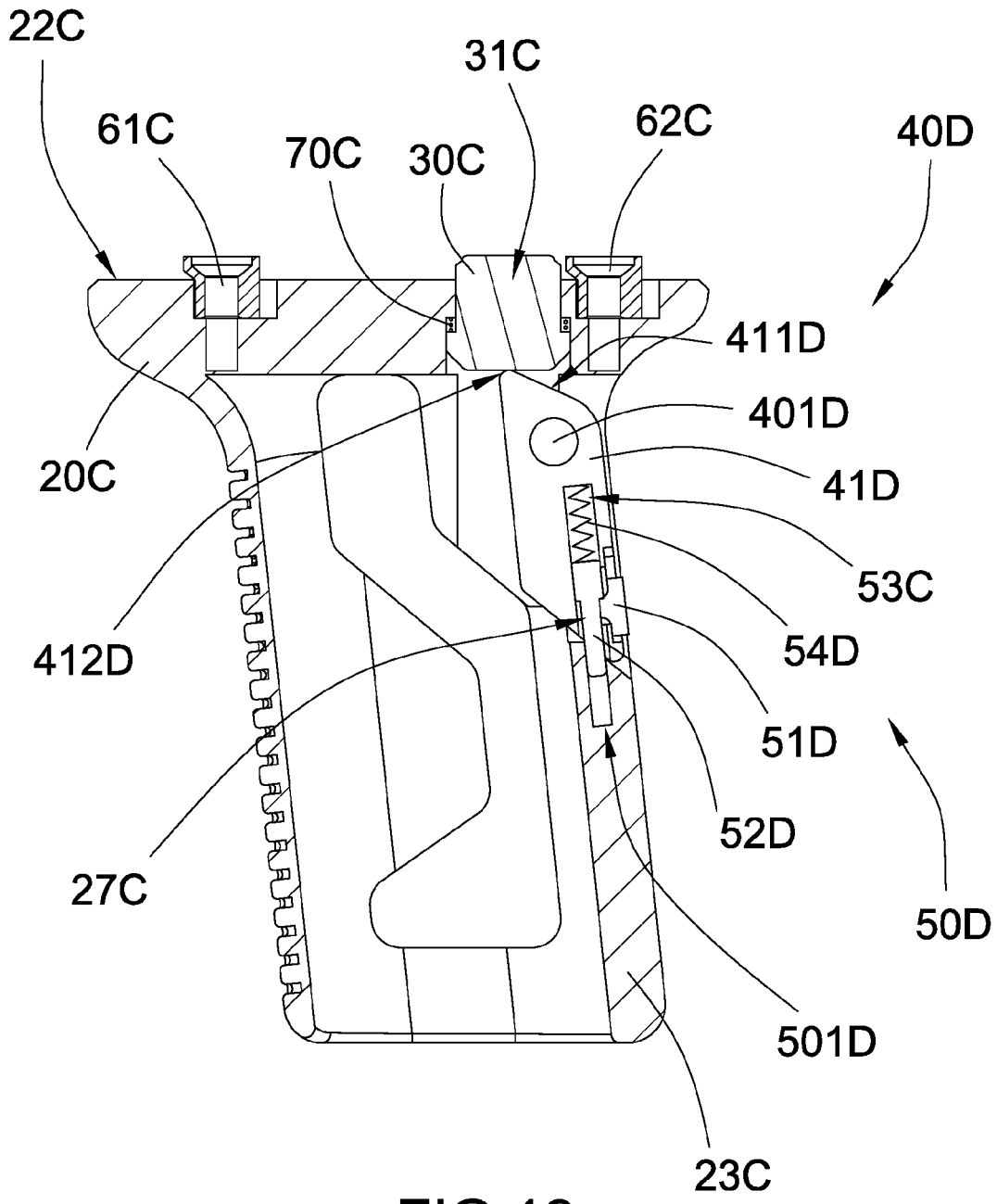
FIG. 19 is a sectional view of the first alternative mode of the KeyMod quick mounting arrangement according to the second preferred embodiment of the present invention, illustrating the coupling head in the securing position.

FIGS. 17 to 19 illustrate a first alternative mode of the actuating unit 40D, wherein the actuating unit 40D comprises an actuating member 41D pivotally coupled at the sidewall 23C of the mounting body 20C at the actuating slot 27C thereof. The actuating member 41D has a pivot end pivotally coupled at the mounting body 20C at the pivot point 401D and a folding end to drive the actuating member 41D in a pivotal movement at the pivot point 401D.

The actuating member 41D has trapezoid shaped and defines a top flat supporting surface 411D and a pushing corner 412D extended from the supporting surface 411D. Accordingly, the distance between the supporting surface 411D and the pivot point 401D is shorter than the distance between the pushing corner 412D and the pivot point 401D.

When the folding end of the actuating member 41D is pivotally moved toward the sidewall 23C of the mounting body 20C, the coupling head 30C is pushed by the pushing corner 412D of the actuating member 41D in the securing position. It is worth mentioning that the bottom side of the coupling head 30C is pushed by the pusher corner 412D of the actuating member 41D. When the folding end of the actuating member 41D is pivotally moved away from the sidewall 23C of the mounting body 20C, the bottom side of the coupling head 30C is supported by the supporting surface 411D of the actuating member 41D in the releasing position. Preferably, the pushing corner 412D of the actuating member 41D is a round corner, such that when the folding end of the actuating member 41D is pivotally moved toward the sidewall 23C of the mounting body 20C, the pushing corner 412D of the actuating member 41D is pivotally slid at the bottom side of the coupling head 30C in order to drive the coupling head 30C between the securing position and the releasing position.

The locker unit 50D is also provided for releasably locking the coupling head 30C in the securing position, wherein the locker unit 50D is arranged to lock up the actuating member 41D at the sidewall 23C of the mounting body 20C in order to lock up the coupling head 30C in the securing position.

The locker unit 50D has a locking groove 501D formed at the sidewall of the mounting body 20C. In particular, the locking groove 501D is indently formed at the bottom edge of the actuating slot 27C.

The locker unit 50D further comprises a releasable switch 51D and a locking latch 52D movably coupled at the actuating member 41D, wherein the locking latch 52D is actuated by the releasable switch 51D to releasably engage with the locking groove 501D at the sidewall 23C of the mounting body 20C. As shown in FIGS. 18 and 19, the locking unit 50D further has a locker slot 53D formed at the actuating member 41D and extended to the folding end of the actuating member 41D, wherein the locking latch 52D is slidably disposed at the locker slot 53C. The releasable switch 51D is coupled to the locking latch 52D and is slidably coupled at the outer surface of the actuating member 41D.

When the folding end of the actuating member 41D is pivotally moved to the sidewall 23C of the mounting body 20C, the locking latch 52D is moved to engage with the locking groove 53D to lock up the actuating member 41D at the sidewall 23C of the mounting body 20C, so as to lock up the coupling head 30C in the securing position. Accordingly, the locking latch 52D is moved downwardly to engage with the locking groove 53D.

When the releasable switch 51D is moved upwardly, the locking latch 52D is driven to move upwardly for disengaging with the locking groove 53D. When the locking latch 52D is moved to disengage with the locking groove 53D, the folding end of the actuating member 41D is allowed to be pivotally moved away from the sidewall 23C of the mounting body 20C so as to move the coupling head 30C from the securing position to the releasing position.

Preferably, the locker unit 50D further comprises a locker spring 54D disposed in the locker slot 53D for applying a pushing force against the locking latch 52D to push the locking latch 52D toward the locking groove 53D so as to ensure the locking latch 52D to be engaged with the locking groove 53D once the folding end of the actuating member 41D is folded toward the sidewall 23C of the mounting body 20C. In other words, in order to unlock the locking latch 52D, the releasable switch 51D must be moved to against the force generated by the locker spring 54D. It is worth mentioning that the bottom edge of the actuating slot 27C has a slanted surface to enable the locking latch 52D to slide thereon in order to engage with the locking groove 53D.

Figure 20:
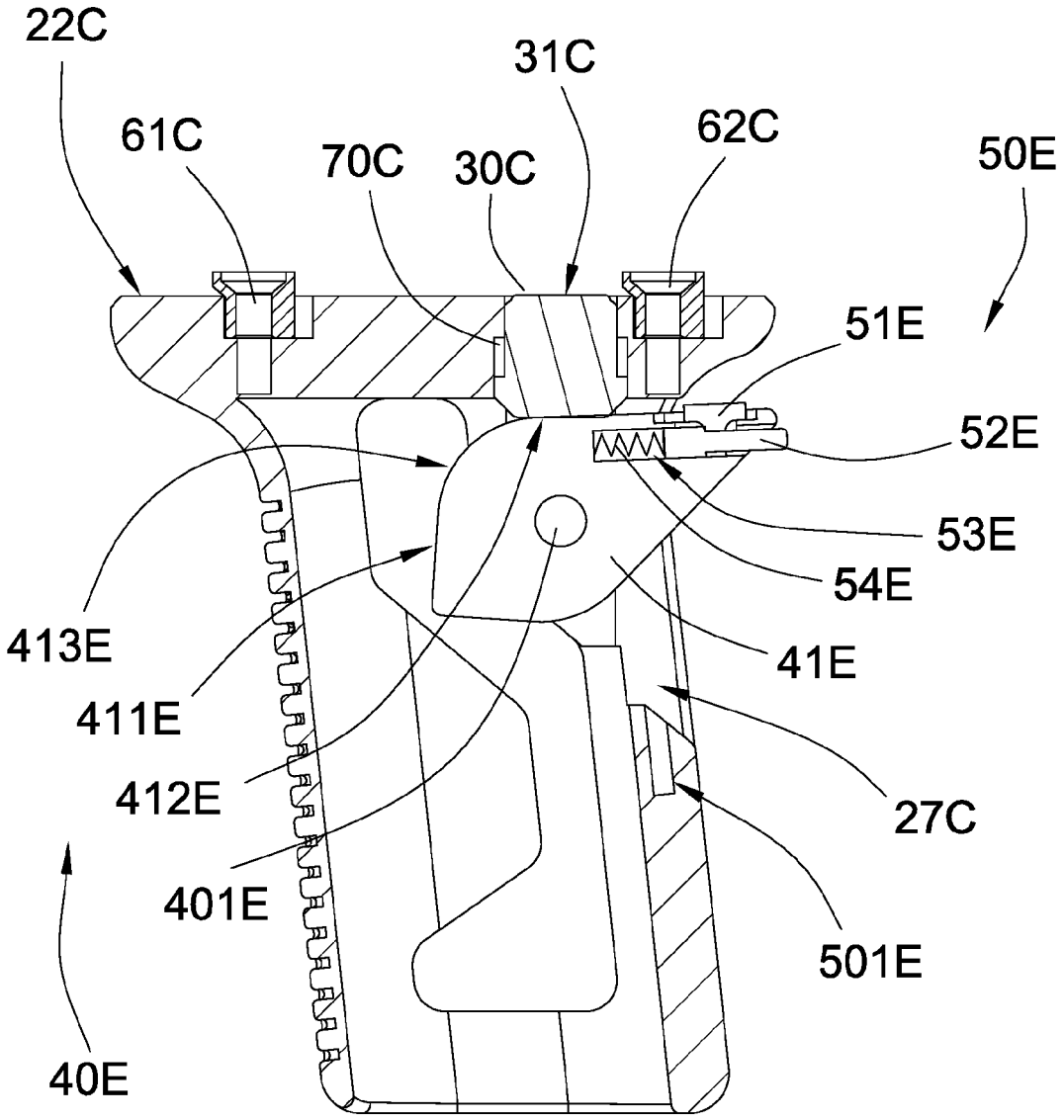
FIG. 20 is a sectional view of a second alternative mode of the KeyMod quick mounting arrangement according to the second preferred embodiment of the present invention, illustrating the coupling head in the releasing position.
Figure 21:
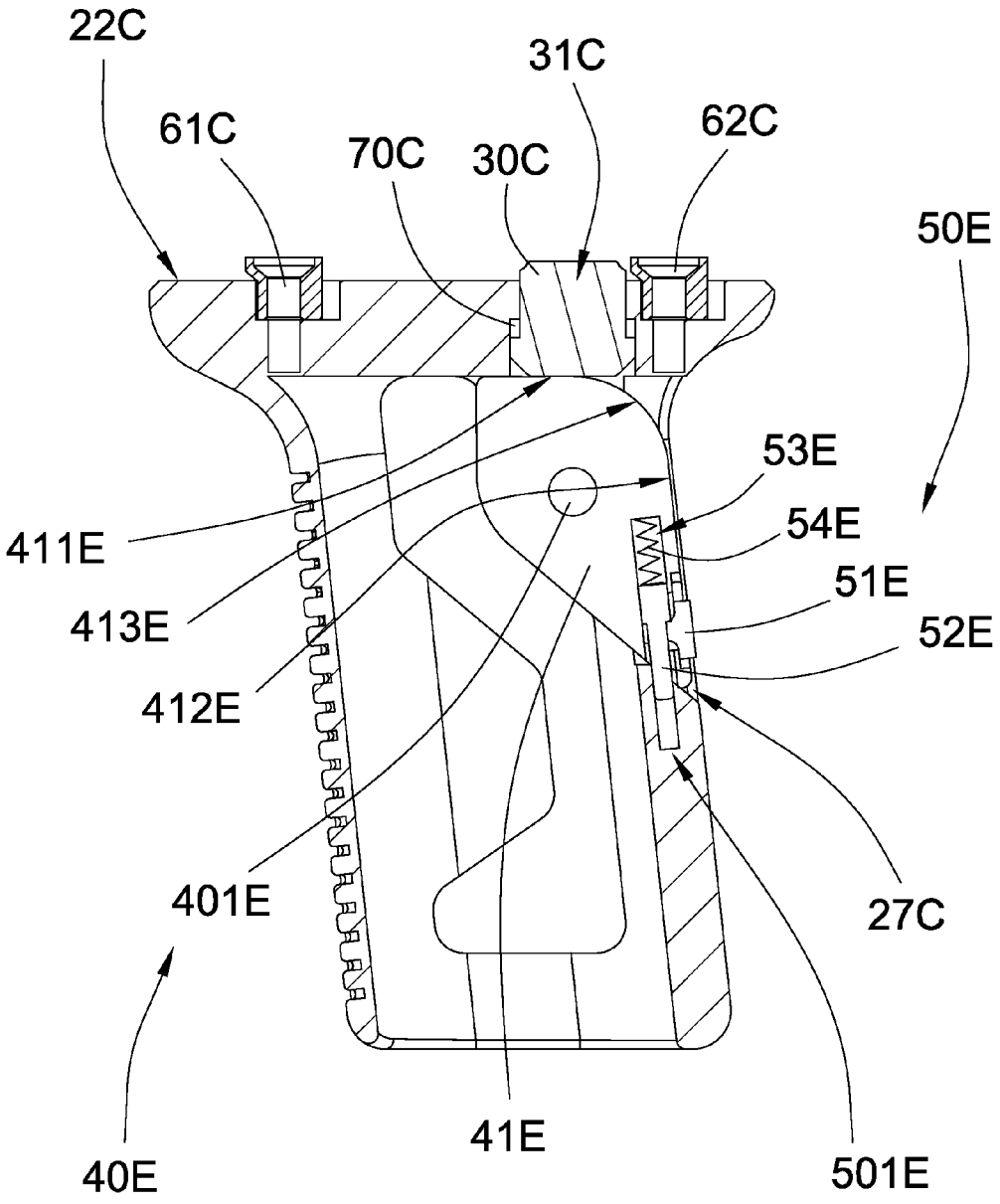
FIG. 21 is a sectional view of the second alternative mode of the KeyMod quick mounting arrangement according to the second preferred embodiment of the present invention, illustrating the coupling head in the securing position.
Figure 22:
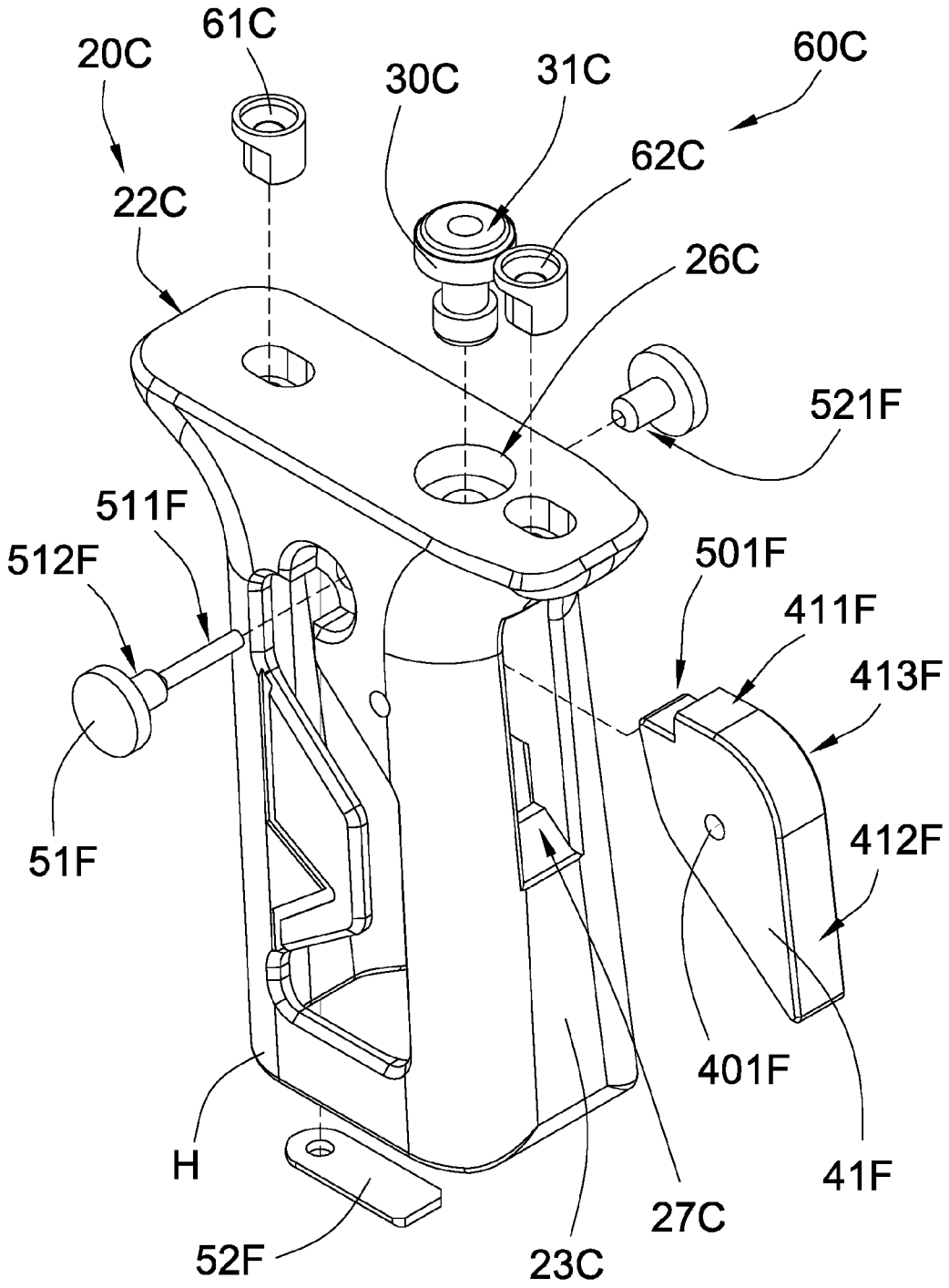
FIG. 22 illustrates a third alternative mode of the KeyMod quick mounting arrangement according to the second preferred embodiment of the present invention.
Figure 23:
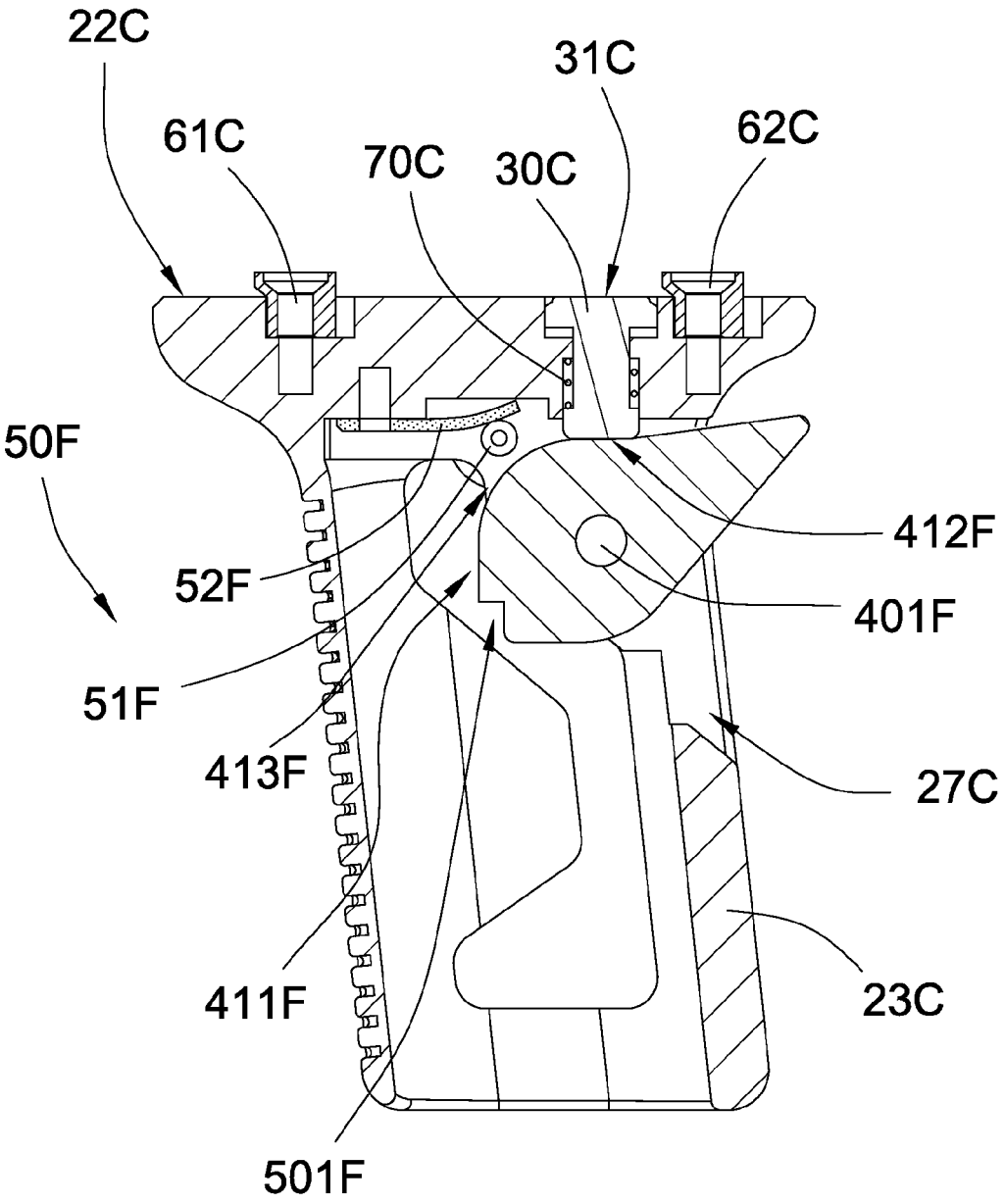
FIG. 23 is a sectional view of the third alternative mode of the KeyMod quick mounting arrangement according to the second preferred embodiment of the present invention, illustrating the coupling head in the releasing position.

FIGS. 20 and 21 illustrate a second alternative mode of the actuating unit 40E, wherein the actuating unit 40E comprises an actuating member 41E pivotally coupled at the sidewall 23C of the mounting body 20C at the actuating slot 27C thereof. The actuating member 41E has a pivot end pivotally coupled at the mounting body 20C at the pivot point 401E and a folding end to drive the actuating member 41E in a pivotal movement at the pivot point 401E.

The actuating member 41E has a top flat supporting surface 411E and a side flat supporting surface 412E. Accordingly, the distance between the top flat supporting surface 411E and the pivot point 401E is larger than the distance between the side flat supporting surface 412E and the pivot point 401E.

When the folding end of the actuating member 41E is pivotally moved toward the sidewall 23C of the mounting body 20C, the coupling head 30C is pushed by the top flat supporting surface 411E of the actuating member 41E in the securing position. It is worth mentioning that the bottom side of the coupling head 30C is pushed by the top flat supporting surface 411E of the actuating member 41E. When the folding end of the actuating member 41E is pivotally moved away from the sidewall 23C of the mounting body 20C, the bottom side of the coupling head 30C is supported by the side flat supporting surface 412E of the actuating member 41E in the releasing position.

The actuating member 41E further has a guiding corner 413E extended between the top flat supporting surface 411E and the side flat supporting surface 412E.

Preferably, the guiding corner 413E of the actuating member 41E is a round corner, such that when the folding end of the actuating member 41E is pivotally moved toward or away from the sidewall 23C of the mounting body 20C, the bottom side of the coupling head 30C is guided to slide between the top flat supporting surface 411E and the side flat supporting surface 412E through the guiding corner 413E in order to drive the coupling head 30C between the securing position and the releasing position.

The locker unit 50E is also provided for releasably locking the coupling head 30C in the securing position, wherein the locker unit 50E is arranged to lock up the actuating member 41E at the sidewall 23C of the mounting body 20C in order to lock up the coupling head 30C in the securing position.

The locker unit 50E has a locking groove 501E formed at the sidewall of the mounting body 20C. In particular, the locking groove 501E is indently formed at the bottom edge of the actuating slot 27C.

The locker unit 50E further comprises a releasable switch 51E and a locking latch 52E movably coupled at the actuating member 41E, wherein the locking latch 52E is actuated by the releasable switch 51E to releasably engage with the locking groove 501E at the sidewall 23C of the mounting body 20C. As shown in FIGS. 20 and 21, the locking unit 50E further has a locker slot 53E formed at the actuating member 41E and extended to the folding end of the actuating member 41E, wherein the locking latch 52E is slidably disposed at the locker slot 53E. The releasable switch 51E is coupled to the locking latch 52E and is slidably coupled at the outer surface of the actuating member 41E.

When the folding end of the actuating member 41E is pivotally moved to the sidewall 23C of the mounting body 20C, the locking latch 52E is moved to engage with the locking groove 53E to lock up the actuating member 41E at the sidewall 23C of the mounting body 20C, so as to lock up the coupling head 30C in the securing position. Accordingly, the locking latch 52E is moved downwardly to engage with the locking groove 53E.

When the releasable switch 51E is moved upwardly, the locking latch 52E is driven to move upwardly for disengaging with the locking groove 53E. When the locking latch 52E is moved to disengage with the locking groove 53E, the folding end of the actuating member 41E is allowed to be pivotally moved away from the sidewall 23C of the mounting body 20C so as to move the coupling head 30C from the securing position to the releasing position.

Preferably, the locker unit 50E further comprises a locker spring 54E disposed in the locker slot 53E for applying a pushing force against the locking latch 52E to push the locking latch 52E toward the locking groove 53E so as to ensure the locking latch 52E to be engaged with the locking groove 53E once the folding end of the actuating member 41E is folded toward the sidewall 23C of the mounting body 20C. In other words, in order to unlock the locking latch 52E, the releasable switch 51E must be moved to against the force generated by the locker spring 54E. It is worth mentioning that the bottom edge of the actuating slot 27C has a slanted surface to enable the locking latch 52E to slide thereon in order to engage with the locking groove 53E.

FIGS. 22 to 26 illustrate a third alternative mode of the actuating unit 40F, wherein the actuating unit 40F comprises an actuating member 41F pivotally coupled at the sidewall 23C of the mounting body 20C at the actuating slot 27C thereof. The actuating member 41F has a pivot end pivotally coupled at the mounting body 20C at the pivot point 401F and a folding end to drive the actuating member 41F in a pivotal movement at the pivot point 401F.

The actuating member 41F has a top flat supporting surface 411F and a side flat supporting surface 412F. Accordingly, the distance between the top flat supporting surface 411F and the pivot point 401F is larger than the distance between the side flat supporting surface 412F and the pivot point 401F.

When the folding end of the actuating member 41F is pivotally moved toward the sidewall 23C of the mounting body 20C, the coupling head 30C is pushed by the top flat supporting surface 411F of the actuating member 41F in the securing position. It is worth mentioning that the bottom side of the coupling head 30C is pushed by the top flat supporting surface 411F of the actuating member 41F. When the folding end of the actuating member 41F is pivotally moved away from the sidewall 23C of the mounting body 20C, the bottom side of the coupling head 30C is supported by the side flat supporting surface 412F of the actuating member 41F in the releasing position.

The actuating member 41F further has a guiding corner 413F extended between the top flat supporting surface 411F and the side flat supporting surface 412F.

Preferably, the guiding corner 413F of the actuating member 41F is a round corner, such that when the folding end of the actuating member 41F is pivotally moved toward or away from the sidewall 23C of the mounting body 20C, the bottom side of the coupling head 30C is guided to slide between the top flat supporting surface 411F and the side flat supporting surface 412F through the guiding corner 413F in order to drive the coupling head 30C between the securing position and the releasing position.

The locker unit 50F is also provided for releasably locking the coupling head 30C in the securing position, wherein the locker unit 50F is arranged to lock up the actuating member 41F at the sidewall 23C of the mounting body 20C in order to lock up the coupling head 30C in the securing position.

The locking unit 50F has a locking indention 501F formed at the actuating member 41F and comprises a resilient arm 52F supported within the mounting body 20C at a position that a free end of the resilient arm 52F is engaged with the locking indention 501F to lock up the coupling head 30C in the securing position when the actuating member 41F is pivotally moved to the sidewall 23C of the mounting body 20C.

The locking indention 501F is formed at the inner corner portion of the actuating member 41F which is extended from the top flat supporting surface 411F thereof. The resilient arm 52F is a flexible flat metal panel having an affixing end affixed to the mounting body 20C, wherein the free end of the resilient arm 52F is extended toward the sidewall 23C of the mounting body 20C. Accordingly, the free end of the resilient arm 52F is normally engaged with the locking indention 501F to lock up the pivotally movement of the actuating member 41F. Once the free end of the resilient arm 52F is bent upwardly, the free end of the resilient arm 52F is disengaged with the locking indention 501F, so as to allow the pivotally movement of the actuating member 41F.

The locking unit 50F further comprises a releasable switch 51F slidably coupled at the mounting body 20C to bend the free end of the resilient arm 52F for disengaging with the locking indention 501F so as to enable the actuating member 41F to be pivotally moved away from the sidewall 23C of the mounting body 20C in order to move the coupling head 30C from the securing position to the releasing position.

Figure 24:
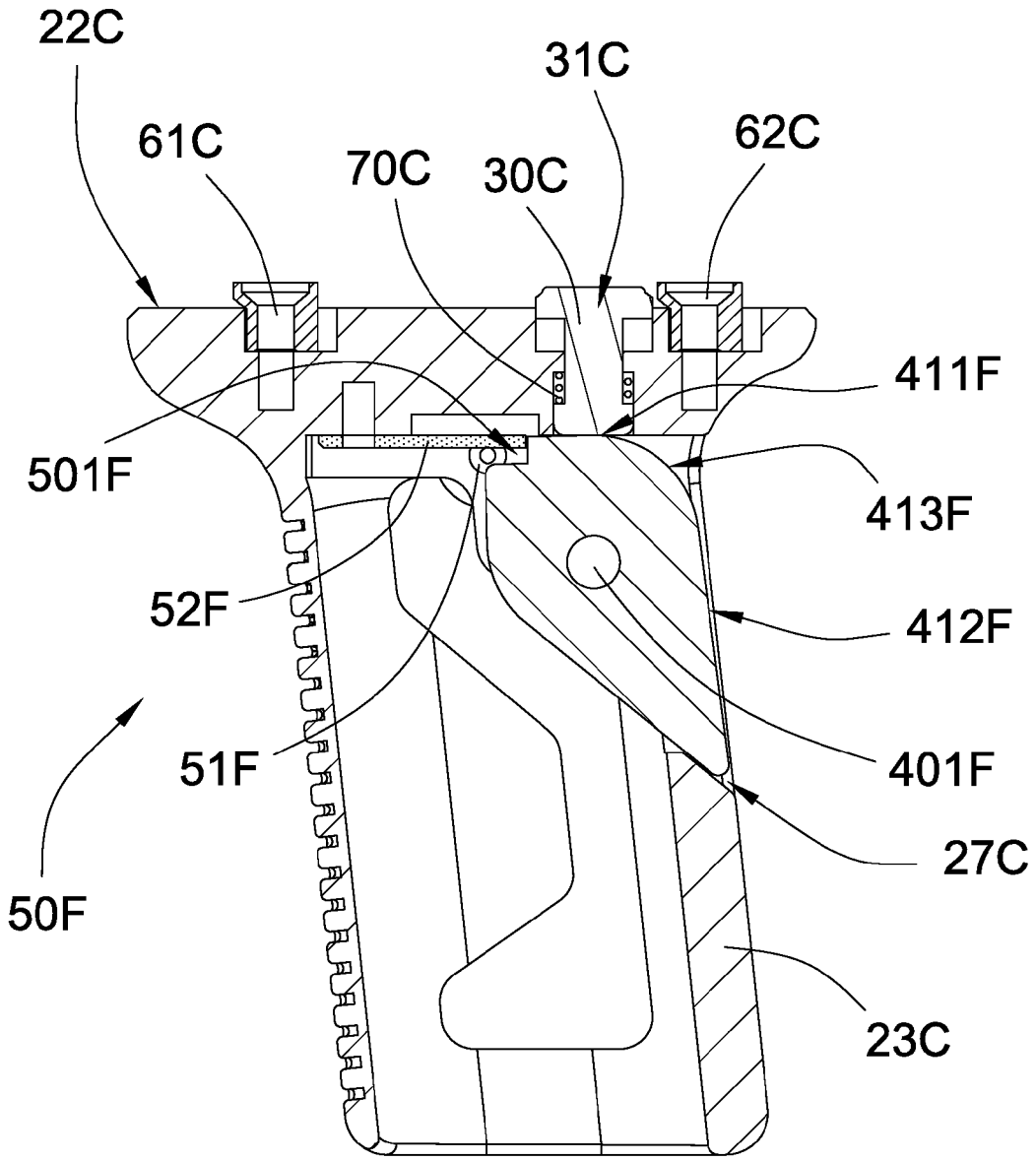
FIG. 24 is a sectional view of the third alternative mode of the KeyMod quick mounting arrangement according to the second preferred embodiment of the present invention, illustrating the coupling head in the securing position.
Figure 26:
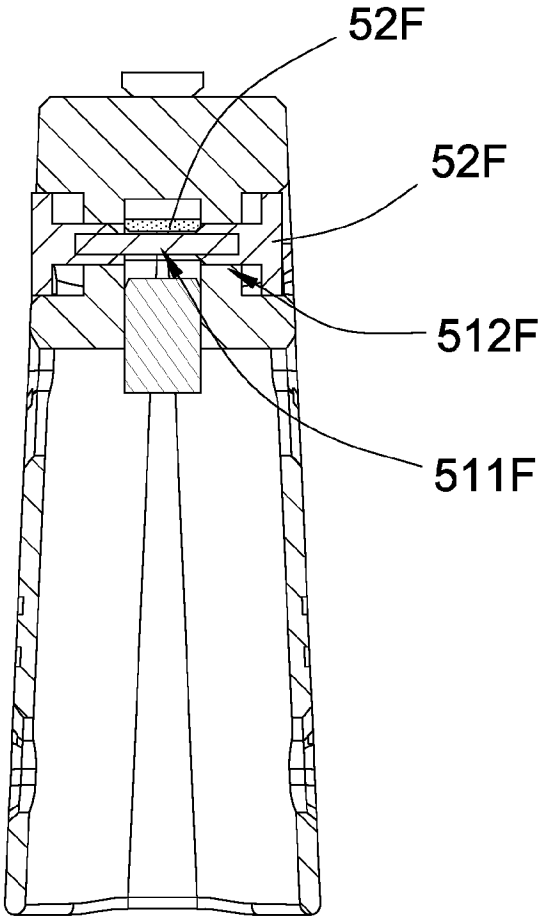
FIG. 26 is a plain view of the third alternative mode of the KeyMod quick mounting arrangement according to the second preferred embodiment of the present invention, illustrating the location of the releasable switch when the coupling head is moved in the securing position.
Figure 25:
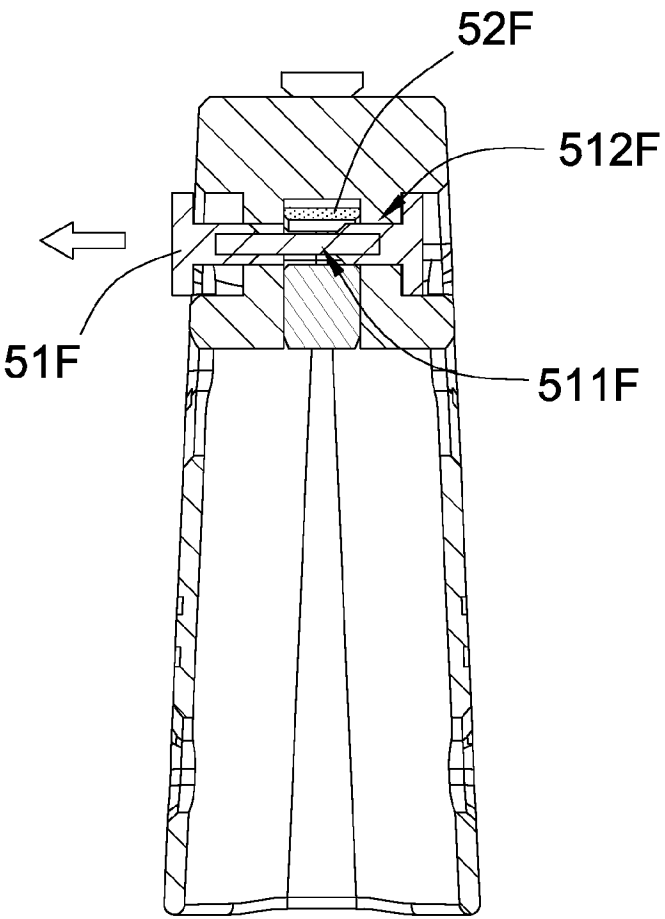
FIG. 25 is a plain view of the third alternative mode of the KeyMod quick mounting arrangement according to the second preferred embodiment of the present invention, illustrating the location of the releasable switch when the coupling head is moved in the releasing position.

As shown in FIGS. 24 to 26, the releasable switch 51F is an elongated member transversely extended from the mounting body 20C in a slidably movable manner. The releasable switch 51F has a slender portion 511F and a thicken portion 512F integrally extended from the slender portion 511F, wherein a size of the thicken portion 512F larger than a size of the slender portion 511F. Accordingly, when the free end of the resilient arm 52F is rested on the slender portion 511F of the releasable switch 51F, as shown in FIG. 26, the resilient arm 52F forms a straight and non-bent member that the free end of the resilient arm 52F is engaged with the locking indention 501F. When the releasable switch 51F is actuated to slide transversely, the free end of the resilient arm 52F shifted from the slender portion 511F of the releasable switch 51F to rest on the thicken portion 512F thereof. As a result, the free end of the resilient arm 52F is bent upwardly by the thicken portion 512F of the releasable switch 51F to disengage with the locking indention 501F. Preferably, the releasable switch 51F has two thicken portions 512F, wherein the slender portion 511F is integrally extended between the two thicken portions 512F, such that the releasable switch 51F can be transversely moved at either direction to shift the free end of the resilient arm 52F from the slender portion 511F of the releasable switch 51F to one of the thicken portions 512F thereof.

It is worth mentioning that when the releasable switch 51F is actuated to slide transversely to bend the free end of the resilient arm 52F, the actuating member 41F is also pushed downwardly at the locking indention 501F by the releasable switch 51F so as to pivotally move the actuating member 41F away from the sidewall 23C of the mounting body 20C at the same time. It is appreciated that a coil spring can be coupled at the pivot point 401F to pivotally move the actuating member 41F away from the sidewall 23C of the mounting body 20C.

Figure 27:
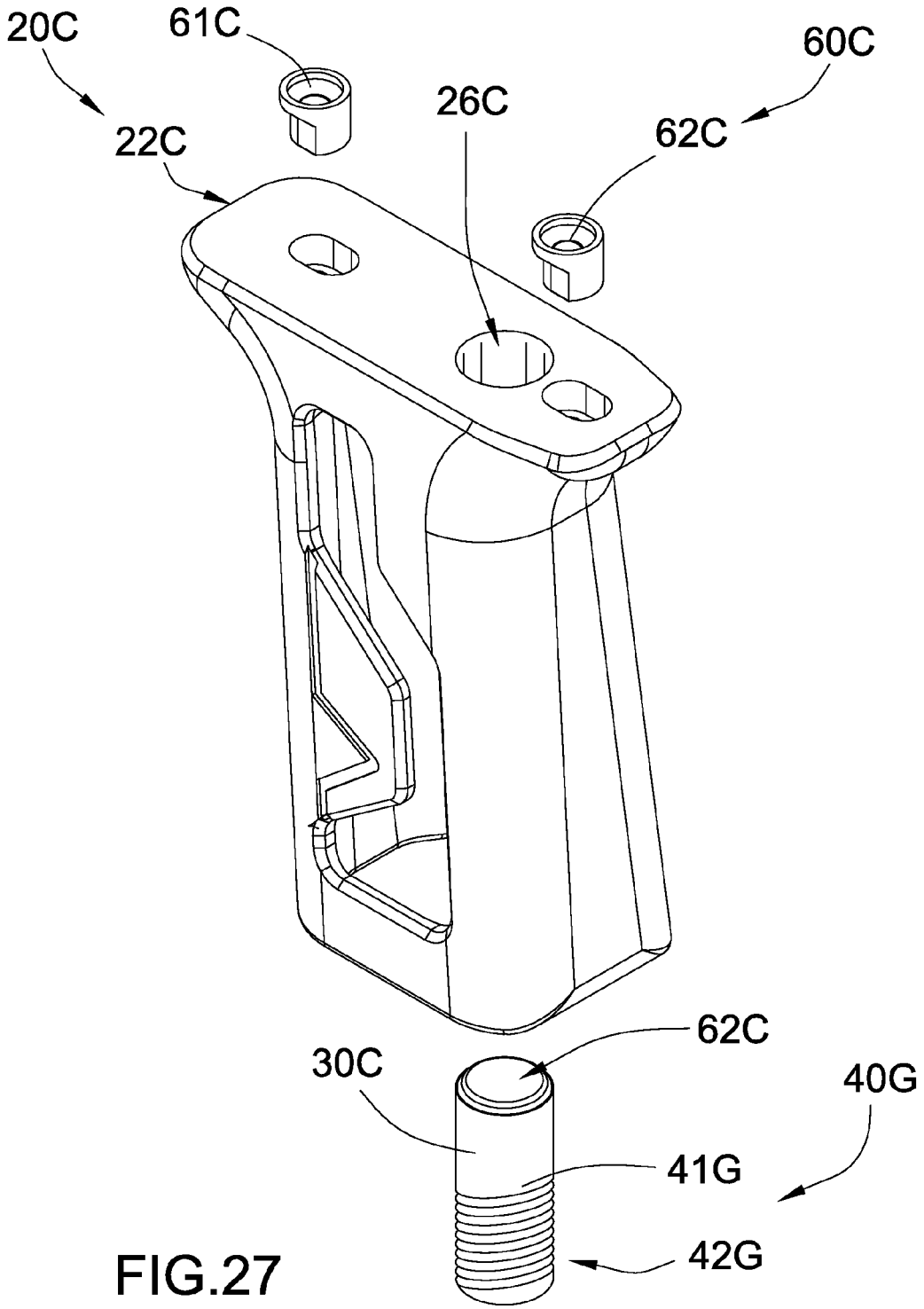
FIG. 27 illustrates a fourth alternative mode of the KeyMod quick mounting arrangement according to the second preferred embodiment of the present invention.
Figure 28:
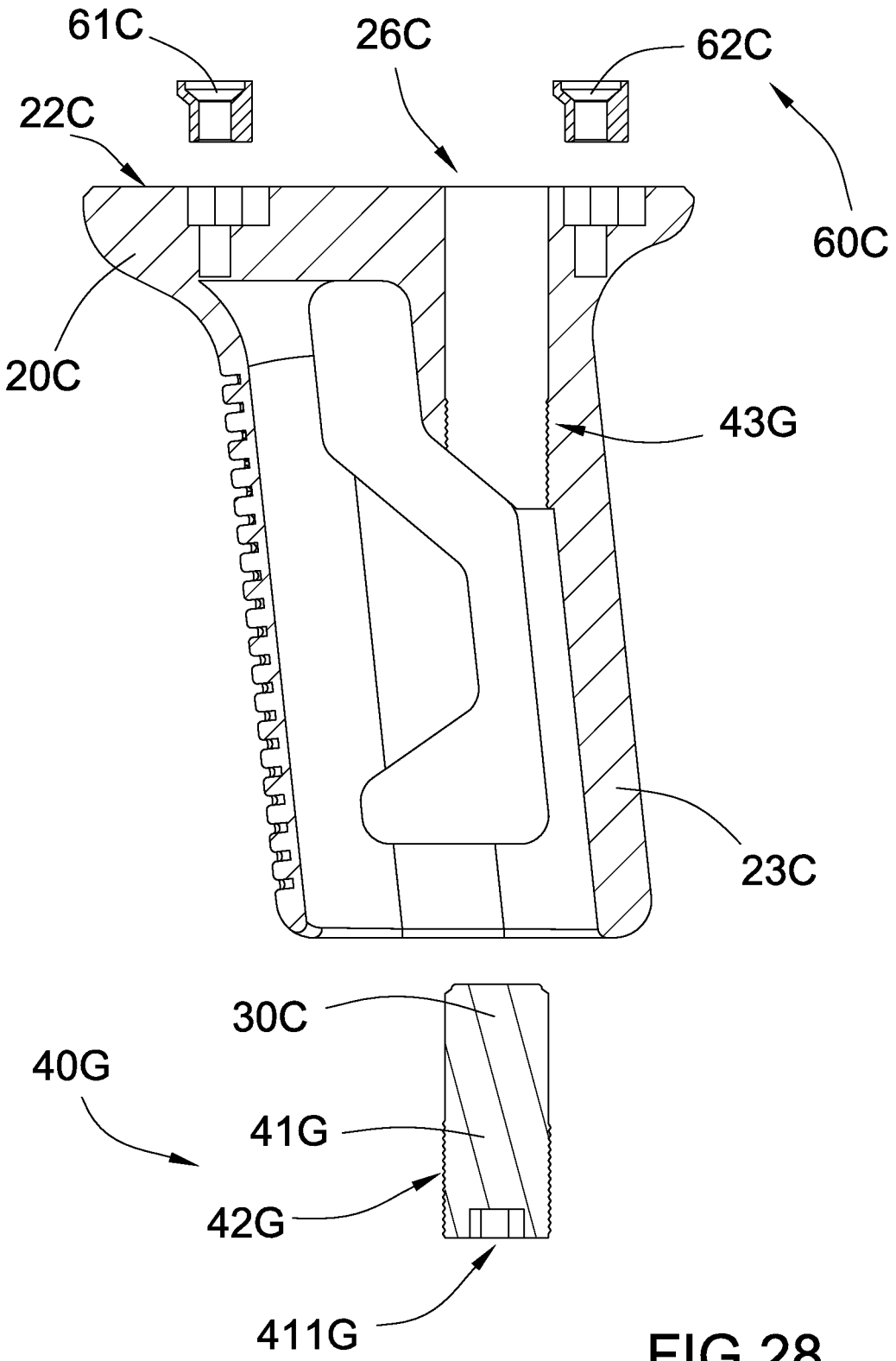
FIG. 28 is a sectional view of the fourth alternative mode of the KeyMod quick mounting arrangement according to the second preferred embodiment of the present invention.

FIGS. 27 and 28 illustrate a fourth alternative mode of the actuating unit 40G for moving the coupling head 30C between the securing position and the releasing position. The actuating unit 40G comprises an actuating member 41G which is extended from the coupling head 30C and is rotatably coupled with the mounting body 20C.

In particular, the actuating member 41G is integrally and downwardly extended from the coupling head 30C, wherein an outer threaded portion 42G is formed at the actuating member 41G to rotatably engage with an inner thread portion 43G formed at an inner wall of the sliding slot 26C of the mounting body 20C. When the actuating member 41G is rotated at one direction, the head portion 31C of the coupling head 30C is moved to be protruded from the second side 22C of the mounting body 20C in the securing position. When the actuating member 41G is rotated at an opposite direction, the head portion 31C of the coupling head 30C is moved back to the second side 22C of the mounting body 20C in the releasing position. Preferably, an actuating slot 411G is formed at the bottom side of the actuating member 41G in order to drive the actuating member 41G.

Figure 29:
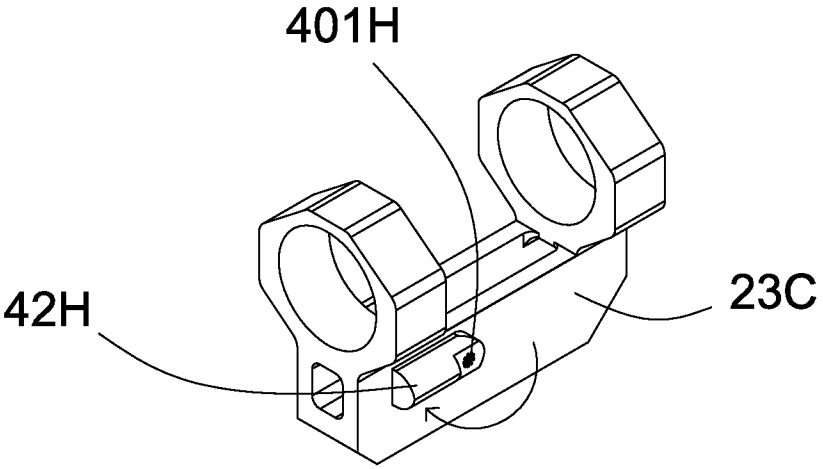
FIG. 29 illustrates a fifth alternative mode of the KeyMod quick mounting arrangement according to the second preferred embodiment of the present invention, illustrating the location of the releasable switch when the coupling head is moved in the releasing position.
Figure 32:
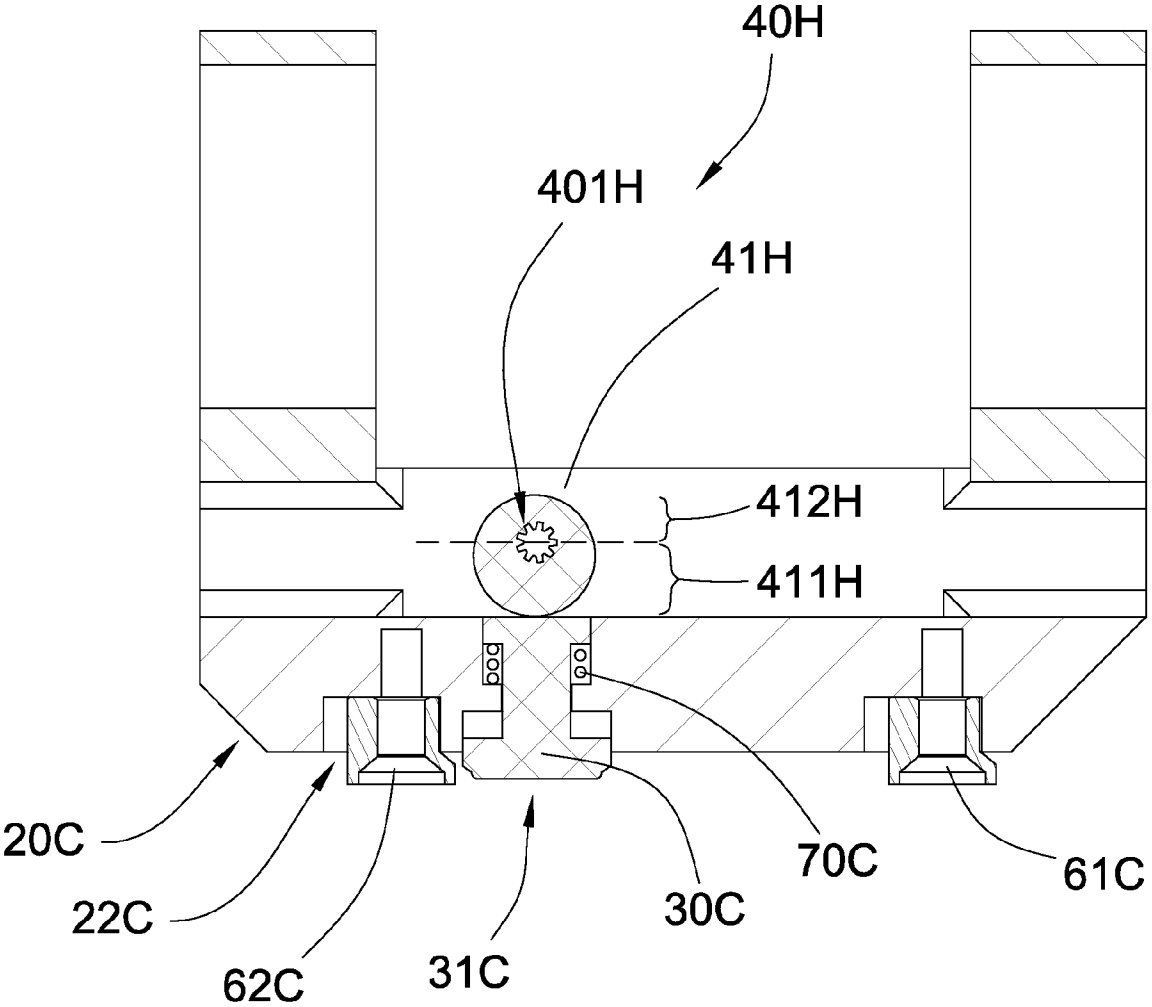
FIG. 32 is a sectional view of the fourth alternative mode of the KeyMod quick mounting arrangement according to the second preferred embodiment of the present invention, illustrating the coupling head in the securing position.

FIGS. 29 and 32 illustrate a mounting ring arrangement serving as the accessory to be mounted at the firearm via the arrangement of the present invention as another example. FIGS. 29 and 32 also illustrate a fifth alternative mode of the actuating unit 40H for moving the coupling head 30C between the securing position and the releasing position. The actuating unit 40H comprises an actuating member 41H transversely and rotatably supported at the mounting body 20C at a position that a rotatable axle 401H is located off-center of the actuating member 41H. In particular, the actuating member 41H has a driving portion 411H defined at the longest distance between an circumferential surface and the rotatable axle 401H and a releasing portion 412H defined at the shortest distance between the circumferential surface and the rotatable axle 401H.

Figure 30:
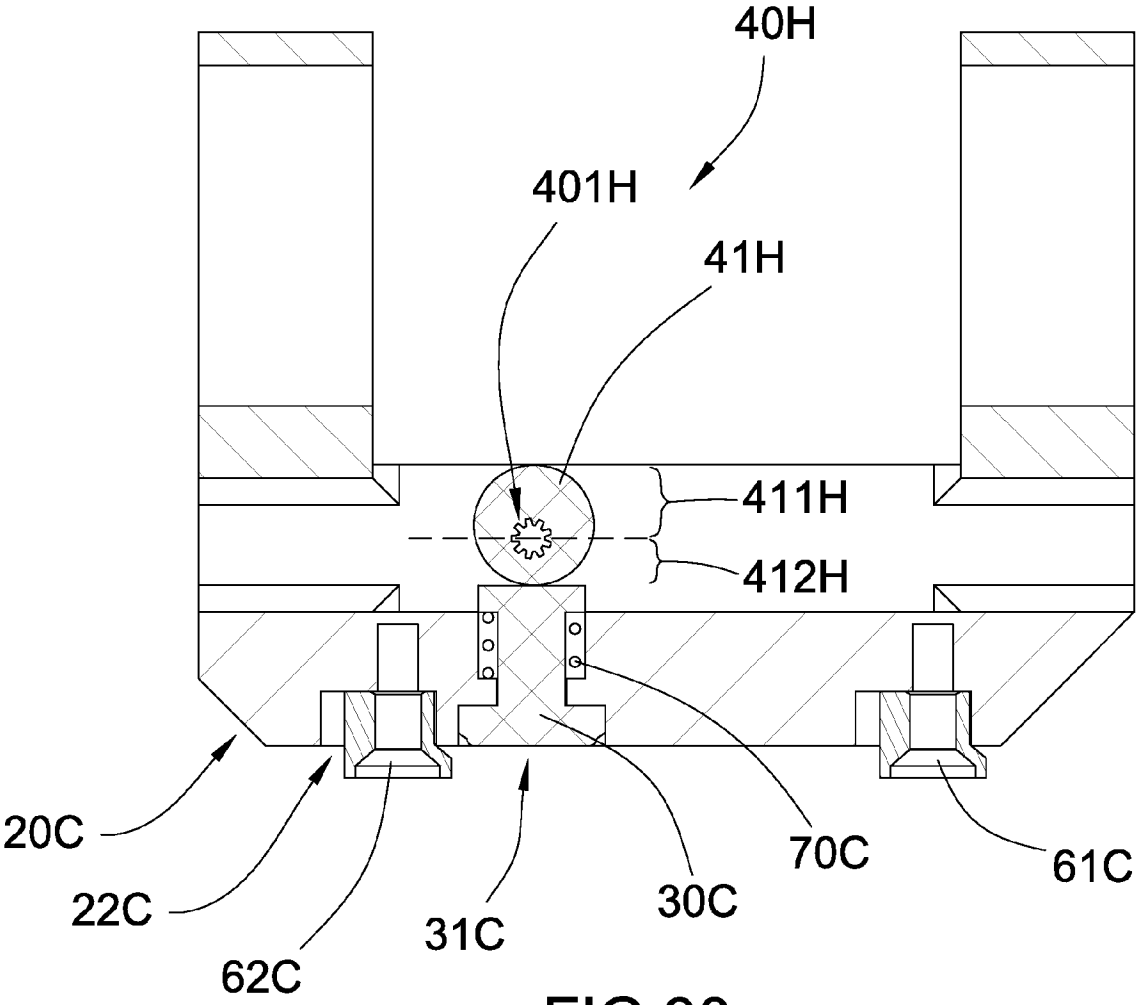
FIG. 30 is a sectional view of the fifth alternative mode of the KeyMod quick mounting arrangement according to the second preferred embodiment of the present invention, illustrating the coupling head in the releasing position.
Figure 31:
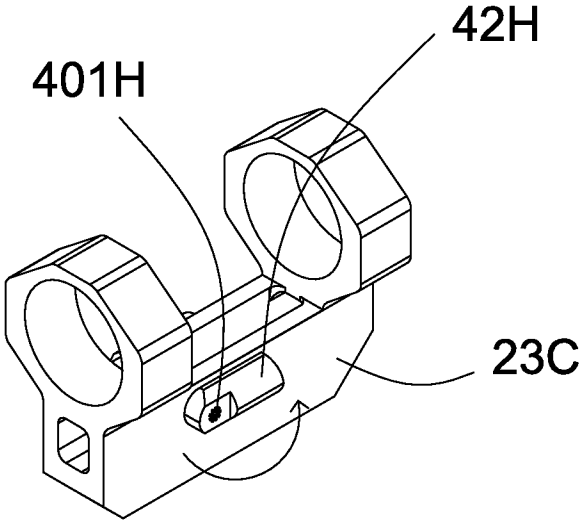
FIG. 31 is a perspective view of the fifth alternative mode of the KeyMod quick mounting arrangement according to the second preferred embodiment of the present invention, illustrating the location of the releasable switch when the coupling head is moved in the securing position.

The actuating unit 40H further comprises a releasable switch 42H coupled at the actuating member 41H at the rotatable axle 401H to drive the actuating member 41H to rotate. When the releasable switch 42H is rotated at one direction about the rotatable axle 401H, as shown in FIG. 31, the head portion 31C of the coupling head 30C is moved to be protruded from the second side 22C of the mounting body 20C by the driving portion 411H of the actuating member 41H, as shown in FIG. 32. When the releasable switch 41H is rotated at an opposite direction, as shown in FIG. 29, the head portion 31C of the coupling head 30C is moved back to the second side 22C of the mounting body 20C by the releasing position 412H of the actuating member 41H, as shown in FIG. 30.

Figure 33:
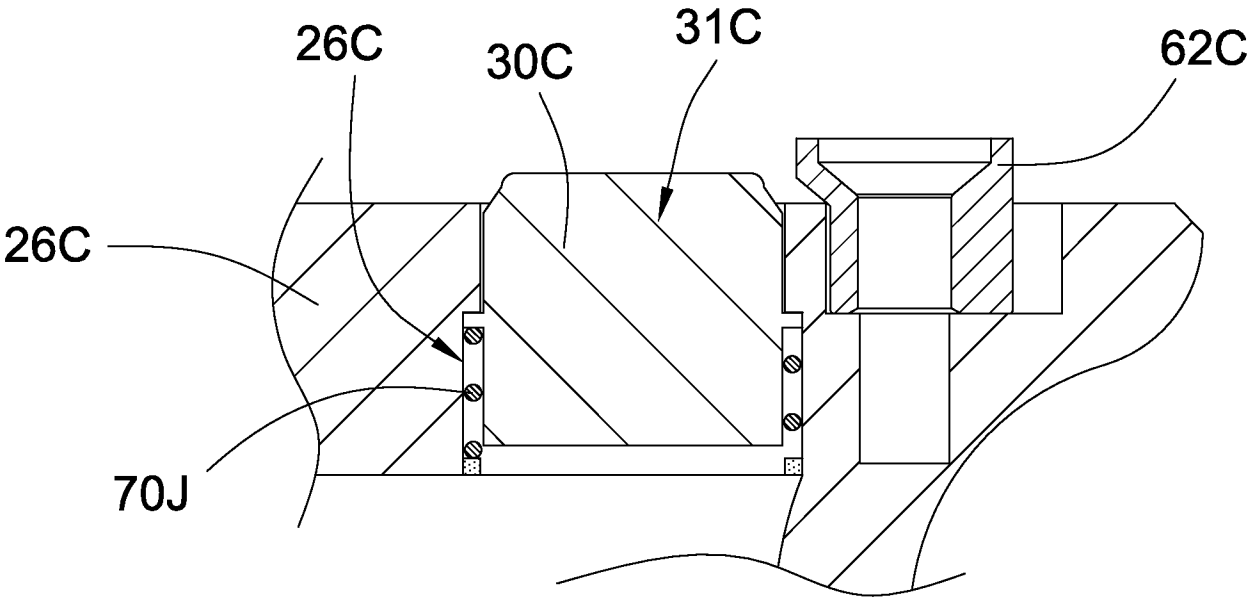
FIG. 33 illustrates an alternative mode of the resilient element of the KeyMod quick mounting arrangement according to the second preferred embodiment of the present invention.

FIG. 33 illustrates an alternative mode of the resilient element 70J which is supported in the sliding slot 26C for biasing against the coupling head 30C to normally push the coupling head 30C from the releasing position to the securing position, so as to ensure the coupling head 30C to be normally retained at the securing position.

As shown in FIG. 33, the resilient element 70J is a compression spring coaxially disposed in the sliding slot 26C, wherein the resilient element 70J has a bottom end biased against an inner wall ridge of the sliding slot 26C and an upper end biased against an outer wall ridge of the coupling head 30C. Therefore, the resilient element 70J will apply an upward pushing force against the coupling head 30C to push the coupling head 30C up to the securing position from the releasing position. In other words, the coupling head 30C will be normally retained in the securing position via the resilient element 70J.

Therefore, the difference between the resilient element 70C as shown in FIGS. 12 to 32 and the resilient element 70J as shown in FIG. 33 is that the coupling head 30C will be normally retained in the releasing position via the resilient element 70C while the coupling head 30C will be normally retained in the securing position via the resilient element 70J. As a result, the user must actuate the actuating member to move the coupling head 30C in the securing position by applying a force against the force of the resilient element 70C. Alternatively, the user must actuate the actuating member to move the coupling head 30C in the releasing position by applying a force against the force of the resilient element 70J. It is worth mentioning that the resilient element 70J can be used as a replacement of the resilient element 70C as shown in FIGS. 12 to 32, such that the configurations between the resilient element 70C and resilient element 70J are interchangeable.

In view of the second embodiment and its alternatives, the accessory is stationary when the coupling head 30C is moved between the securing position and the releasing position. Therefore, once the positioning members 61C, 62C are slid to engage with the mounting slots 10 respectively, the mounting body 20C and the accessory will stationary to prevent any unwanted disengagement between the positioning members 61C, 62C and the mounting slots 10. Then, the user is able to actuate the actuating member to move and lock the coupling head 30C with the mounting slot 10, so as to secure the accessory at the firearm. The user is able to quickly release the accessory from the firearm by simply disengaging the coupling head 30C with the mounting slot 10 via the actuating unit and by slidably disengaging the positioning members 61C, 62C with the mounting slots 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A quick mounting arrangement for detachably coupling an accessory at a firearm having one or more mounting slots, comprising:

a mounting body having a first side adapted for extending from said accessory to be detachably coupled with said firearm, and an opposed second side;

a positioning unit which comprises a positioning member protruded from said second side of said mounting body for detachably engaging with a narrow slot portion of said mounting slot;

a coupling head, which is movably extended from said mounting body between a releasing position and a securing position, having a head portion for engaging with said mounting slot, wherein in said securing position, said head portion of said coupling head is arranged for being disposed in an enlarged slot portion of said mounting slot so as to secure said accessory at said firearm, and in said releasing position, said head portion of said coupling head is arranged for disengaging with said enlarged slot portion of said mounting slot so as to enable said accessory to be detached from said firearm; and an actuating unit for moving said coupling head between said securing position and said releasing position, wherein said actuating unit comprises an actuating member pivotally coupled at a sidewall of said mounting body to push said head portion of said coupling head to be protruded from said second side of said mounting body in said securing position and to pull said head portion of said coupling head back to said second side of said mounting body in said releasing position, wherein said actuating unit further comprises a transmission arm having two ends pivotally coupled at said coupling head and said actuating member respectively, such that when said actuating member is pivotally moved toward said sidewall of said mounting body, said transmission arm is pivotally actuated to push said head portion of said coupling head in said securing position, and when said actuating member is pivotally moved away from said sidewall of said mounting body, said transmission arm is pivotally actuated to pull said head portion of said coupling head in said releasing position.

2. The quick mounting arrangement, as recited in claim 1, wherein said coupling head is slidably coupled at said mounting body such that in said securing position, said head portion of said coupling head is slidably protruded from said second side of said mounting body for being disposed in said enlarged slot portion of said mounting slot, and in said releasing position, said head portion of said coupling head is slid back to align with said second side of said mounting body for disengaging with said enlarged slot portion of said mounting slot.

3. The quick mounting arrangement, as recited in claim 2, wherein said mounting body further has a sliding slot indently formed on said second side of said mounting body, wherein said coupling head is slidably disposed at said sliding slot to guide said coupling head to slide between said securing position and said releasing position.

4. The quick mounting arrangement, as recited in claim 1, wherein said positioning member is upwardly protruded from said second side of said mounting body for slidably engaging with said narrow slot portion of said mounting slot from said enlarged slot portion thereof.

5. A quick mounting arrangement for detachably coupling an accessory at a firearm having one or more mounting slots, comprising:

a mounting body having a first side adapted for extending from said accessory to be detachably coupled with said firearm, and an opposed second side;

a positioning unit which comprises a positioning member protruded from said second side of said mounting body for detachably engaging with a narrow slot portion of said mounting slot;

a coupling head, which is movably extended from said mounting body between a releasing position and a securing position, having a head portion for engaging with said mounting slot, wherein in said securing position, said head portion of said coupling head is arranged for being disposed in an enlarged slot portion of said mounting slot so as to secure said accessory at said firearm, and in said releasing position, said head portion of said coupling head is arranged for disengaging with said enlarged slot portion of said mounting slot so as to enable said accessory to be detached from said firearm; and an actuating unit for moving said coupling head between said securing position and said releasing position, wherein said actuating unit comprises an actuating member pivotally coupled at a sidewall of said mounting body to push said head portion of said coupling head to be protruded from said second side of said mounting body in said securing position and to pull said head portion of said coupling head back to said second side of said mounting body in said releasing position, wherein said actuating member has a top flat supporting surface and a pushing corner extended from said supporting surface, such that when said actuating member is pivotally moved toward said sidewall of said mounting body, said coupling head is pushed by said pushing corner of said actuating member in said securing position, and when said actuating member is pivotally moved away from said sidewall of said mounting body, said coupling head is supported by said supporting surface of said actuating member in said releasing position.

6. The quick mounting arrangement, as recited in claim 5, wherein said coupling head is slidably coupled at said mounting body such that in said securing position, said head portion of said coupling head is slidably protruded from said second side of said mounting body for being disposed in said enlarged slot portion of said mounting slot, and in said releasing position, said head portion of said coupling head is slid back to align with said second side of said mounting body for disengaging with said enlarged slot portion of said mounting slot.

7. The quick mounting arrangement, as recited in claim 6, wherein said mounting body further has a sliding slot indently formed on said second side of said mounting body, wherein said coupling head is slidably disposed at said sliding slot to guide said coupling head to slide between said securing position and said releasing position.

8. The quick mounting arrangement, as recited in claim 5, wherein said positioning member is upwardly protruded from said second side of said mounting body for slidably engaging with said narrow slot portion of said mounting slot from said enlarged slot portion thereof.

9. A quick mounting arrangement for detachably coupling an accessory at a firearm having one or more mounting slots, comprising:

a mounting body having a first side adapted for extending from said accessory to be detachably coupled with said firearm, and an opposed second side;

a positioning unit which comprises a positioning member protruded from said second side of said mounting body for detachably engaging with a narrow slot portion of said mounting slot;

a coupling head, which is movably extended from said mounting body between a releasing position and a securing position, having a head portion for engaging with said mounting slot, wherein in said securing position, said head portion of said coupling head is arranged for being disposed in an enlarged slot portion of said mounting slot so as to secure said accessory at said firearm, and in said releasing position, said head portion of said coupling head is arranged for disengaging with said enlarged slot portion of said mounting slot so as to enable said accessory to be detached from said firearm; and an actuating unit for moving said coupling head between said securing position and said releasing position, wherein said actuating unit comprises an actuating member pivotally coupled at a sidewall of said mounting body to push said head portion of said coupling head to be protruded from said second side of said mounting body in said securing position and to pull said head portion of said coupling head back to said second side of said mounting body in said releasing position, wherein said actuating member has a top flat supporting surface, a side flat supporting surface, and a guiding corner extended between said top flat supporting surface and said side flat supporting surface, such that when said actuating member is pivotally moved toward said sidewall of said mounting body, said coupling head is pushed by said top flat supporting surface of said actuating member in said securing position, and when said actuating member is pivotally moved away from said sidewall of said mounting body, said coupling head is supported by said side flat supporting surface of said actuating member in said releasing position.

10. The quick mounting arrangement, as recited in claim 9, wherein said coupling head is slidably coupled at said mounting body such that in said securing position, said head portion of said coupling head is slidably protruded from said second side of said mounting body for being disposed in said enlarged slot portion of said mounting slot, and in said releasing position, said head portion of said coupling head is slid back to align with said second side of said mounting body for disengaging with said enlarged slot portion of said mounting slot.

11. The quick mounting arrangement, as recited in claim 10, wherein said mounting body further has a sliding slot indently formed on said second side of said mounting body, wherein said coupling head is slidably disposed at said sliding slot to guide said coupling head to slide between said securing position and said releasing position.

12. The quick mounting arrangement, as recited in claim 9, wherein said positioning member is upwardly protruded from said second side of said mounting body for slidably engaging with said narrow slot portion of said mounting slot from said enlarged slot portion thereof.

13. The quick mounting arrangement, as recited in claim 9, further comprising a locker unit for releasably locking said coupling head in said securing position, wherein said locker unit has a locking groove formed at said sidewall of said mounting body and comprises a locking latch movably coupled at said actuating member, wherein when said actuating member is pivotally moved to said sidewall of said mounting body, said locking latch is moved to engage with said locking groove so as to lock up said coupling head in said securing position, wherein when said locking latch is moved to disengage with said locking groove, said actuating member is allowed to be pivotally moved away from said sidewall of said mounting body so as to move said coupling head from said securing position to said releasing position.

14. The quick mounting arrangement, as recited in claim 9, further comprising a locker unit for releasably locking said coupling head in said securing position, wherein said locking unit has a locking indention formed at said actuating member and comprises a resilient arm supported by said mounting body at a position that a free end of said resilient arm is engaged with said locking indention to lock up said coupling head in said securing position when said actuating member is pivotally moved to said sidewall of said mounting body, and a releasable switch slidably coupled at said mounting body to bend said free end of said resilient arm for disengaging with said locking indention so as to enable said actuating member to be pivotally moved away from said sidewall of said mounting body in order to move said coupling head from said securing position to said releasing position.

15. A quick mounting arrangement for detachably coupling an accessory at a firearm having one or more mounting slots, comprising:

a mounting body having a first side adapted for extending from said accessory to be detachably coupled with said firearm, and an opposed second side;

a positioning unit which comprises a positioning member protruded from said second side of said mounting body for detachably engaging with a narrow slot portion of said mounting slot;

a coupling head, which is movably extended from said mounting body between a releasing position and a securing position, having a head portion for engaging with said mounting slot, wherein in said securing position, said head portion of said coupling head is arranged for being disposed in an enlarged slot portion of said mounting slot so as to secure said accessory at said firearm, and in said releasing position, said head portion of said coupling head is arranged for disengaging with said enlarged slot portion of said mounting slot so as to enable said accessory to be detached from said firearm; and an actuating unit for moving said coupling head between said securing position and said releasing position, wherein said actuating unit comprises an actuating member rotatably supported at said mounting body at a position that a rotatable axle is located off-center of said actuating member, and a releasable switch coupled at said actuating member at said rotatable axle to drive said actuating member, wherein said actuating member has a driving portion defined at the longest distance between an circumferential surface and said rotatable axle and a releasing portion defined at the shortest distance between said circumferential surface and said rotatable axle, such that when said releasable switch is rotated at one direction, said head portion of said coupling head is moved to be protruded from said second side of said mounting body by said driving portion of said actuating member, and when said releasable switch is rotated at an opposite direction, said head portion of said coupling head is moved back to said second side of said mounting body by said releasing position of said actuating member.

16. The quick mounting arrangement, as recited in claim 15, wherein said coupling head is slidably coupled at said mounting body such that in said securing position, said head portion of said coupling head is slidably protruded from said second side of said mounting body for being disposed in said enlarged slot portion of said mounting slot, and in said releasing position, said head portion of said coupling head is slid back to align with said second side of said mounting body for disengaging with said enlarged slot portion of said mounting slot.

17. The quick mounting arrangement, as recited in claim 16, wherein said mounting body further has a sliding slot indently formed on said second side of said mounting body, wherein said coupling head is slidably disposed at said sliding slot to guide said coupling head to slide between said securing position and said releasing position.

18. The quick mounting arrangement, as recited in claim 15, wherein said positioning member is upwardly protruded from said second side of said mounting body for slidably engaging with said narrow slot portion of said mounting slot from said enlarged slot portion thereof.

19. A quick mounting arrangement for detachably coupling an accessory at a firearm having a mounting slot which has a narrow slot portion and an enlarged slot portion, comprising:

a mounting body having a first side adapted for extending from said accessory to be detachably coupled with said firearm, an opposed second side, and a sliding slot indently formed on said second side of said mounting body;

a positioning unit protruded from said second side of said mounting body for detachably engaging with the narrow slot portion of the mounting slot when said positioning unit is slidably engaged with the narrow slot portion of the mounting slot from the enlarged slot portion thereof; and a coupling head having a head portion, wherein said coupling head is movably disposed at said sliding slot of said mounting body and is reciprocatingly moved between a releasing position and a securing position, wherein at said securing position, said head portion of said coupling head is moved out of said sliding slot for being disposed in the enlarged slot portion of the mounting slot so as to secure said accessory at said firearm, wherein at said releasing position, said coupling head is received in said sliding slot at a position that said head portion of said coupling head is located at same level of or below said second side of said mounting body for disengaging with the enlarged slot portion of the mounting slot so as to enable the accessory to be detached from the firearm.

20. The quick mounting arrangement, as recited in claim 19, wherein said head portion of said coupling head has a tapered circumferential surface that a circumferential size of said head portion is gradually reducing from bottom to top, such that, in said securing position, said tapered circumferential surface of said head portion of said coupling head is arranged for biasing against a rim of said enlarged slot portion of said mounting slot.

* * * * *